US006561917B2

(12) United States Patent
Manwaring

(10) Patent No.: US 6,561,917 B2
(45) **Date of Patent: *May 13, 2003**

(54) SYSTEM AND METHOD FOR MEASURING A GOLFER'S BALL STRIKING PARAMETERS

(75) Inventor: Scott R. Manwaring, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 13 days.

This patent is subject to a terminal disclaimer.

(21) Appl. No.: 09/683,966

(22) Filed: Mar. 7, 2002

(65) Prior Publication Data

US 2002/0098897 A1 Jul. 25, 2002

Related U.S. Application Data

(62) Division of application No. 09/765,691, filed on Jan. 19, 2001, now Pat. No. 6,431,990.

(51) Int. Cl.[7] ..... A63B 69/36

(52) U.S. Cl. ..... 473/151; 473/409; 473/199

(58) Field of Search ..... 473/54–55, 131, 473/139–140, 198–200, 219–226, 150–151, 409; 434/247, 252, 257, 251, 249

(56) References Cited

U.S. PATENT DOCUMENTS

| | | | |
|---|---|---|---|
| 2,610,504 | A | 4/1952 | Nigh |
| 2,660,880 | A | 12/1953 | Vivian |
| 2,755,658 | A | 7/1956 | Brown |
| 3,091,466 | A | 5/1963 | Speiser |
| 3,359,005 | A | 12/1967 | Cameron |
| 3,364,751 | A | 1/1968 | Cornell |
| 3,508,440 | A | 4/1970 | Murphy |
| 3,513,707 | A | 5/1970 | Russell |
| 3,566,668 | A | 3/1971 | Browning |
| 3,598,976 | A | 8/1971 | Russell |
| 3,630,601 | A | 12/1971 | Lehovec |
| 3,633,007 | A | 1/1972 | Sanders |
| 3,633,008 | A | 1/1972 | Sanders |
| 3,671,724 | A | 6/1972 | Sanders |
| 3,759,528 | A | 9/1973 | Christophers |
| 3,804,518 | A | 4/1974 | Meyr |
| 3,935,669 | A | 2/1976 | Potrzuski |
| 4,041,293 | A | 8/1977 | Kihlberg |
| 4,063,259 | A | 12/1977 | Lynch |
| 4,136,387 | A | 1/1979 | Sullivan |
| 4,137,566 | A | 1/1979 | Haas |
| 4,148,096 | A | 4/1979 | Haas |
| 4,155,555 | A | 5/1979 | Fink |
| 4,158,853 | A | 6/1979 | Sullivan |
| 4,160,942 | A | 7/1979 | Lynch |
| 4,306,722 | A | 12/1981 | Rusnak |
| 4,327,918 | A | 5/1982 | Foster |

(List continued on next page.)

FOREIGN PATENT DOCUMENTS

| | | |
|---|---|---|
| WO | WO 00/43936 | 7/2000 |

*Primary Examiner*—Mark Sager
(74) *Attorney, Agent, or Firm*—Michael A. Catania

(57) ABSTRACT

A system (20) for capturing and analyzing golf club information and golf ball information during and after a golfer's swing is disclosed herein. The golf club information includes golf club head orientation, golf club head velocity, and golf club spin. The golf club head orientation includes dynamic lie, loft and face angle of the golf club head. The golf club head velocity includes path of the golf club head, attack of the golf club head and downrange information. The golf ball information includes golf ball velocity, golf ball launch angle, golf ball side angle, golf ball speed manipulation and golf ball orientation. The golf ball orientation includes the true spin of the golf ball, and the tilt axis of the golf ball which entails the back spin and the side spin of the golf ball. The system includes camera units (26 and 28), a trigger device (30) and a computer (22).

6 Claims, 21 Drawing Sheets

U.S. PATENT DOCUMENTS

| | | | |
|---|---|---|---|
| 4,375,887 | A | 3/1983 | Lynch |
| 4,477,079 | A | 10/1984 | White |
| 4,630,829 | A | 12/1986 | White |
| 4,640,120 | A | 2/1987 | Garritano |
| 4,711,754 | A | 12/1987 | Bednar |
| 4,844,469 | A | 7/1989 | Yasuda |
| 4,898,388 | A | 2/1990 | Beard, III |
| 4,967,596 | A | 11/1990 | Rilling |
| 4,991,851 | A | 1/1991 | Melesio |
| 4,991,850 | A | 2/1991 | Wilhelm |
| 5,054,785 | A | 10/1991 | Gobush |
| 5,082,283 | A | 1/1992 | Conley |
| 5,111,410 | A | 5/1992 | Nakayama |
| 5,118,102 | A | 6/1992 | Bahill |
| 5,226,660 | A | 7/1993 | Curchod |
| 5,246,232 | A | 9/1993 | Eccher |
| 5,247,835 | A | 9/1993 | Howell |
| 5,259,617 | A | 11/1993 | Soong |
| 5,342,051 | A | 8/1994 | Rankin |
| 5,441,256 | A | 8/1995 | Hackman |
| 5,469,627 | A | 11/1995 | Denny |
| 5,471,383 | A | 11/1995 | Gobush |
| 5,486,002 | A | 1/1996 | Witler |
| 5,501,463 | A | 3/1996 | Gobush |
| 5,575,719 | A | 11/1996 | Gobush |
| 5,609,534 | A | 3/1997 | Gebhardt |
| 5,803,823 | A | 9/1998 | Gobush |
| 5,879,246 | A | 3/1999 | Gebhardt |
| 6,042,483 | A | 3/2000 | Katayama |
| 6,185,850 | B1 | 2/2001 | Erkel |
| 6,186,910 | B1 | 2/2001 | Kobayashi |
| 6,195,090 | B1 | 2/2001 | Riggins |
| 6,241,622 | B1 | 6/2001 | Gobush |
| 6,292,130 | B1 | 9/2001 | Cavallaro |
| 6,293,802 | B1 | 9/2001 | Ahlgren |
| 6,431,990 | B1 * | 8/2002 | Manwaring |

* cited by examiner

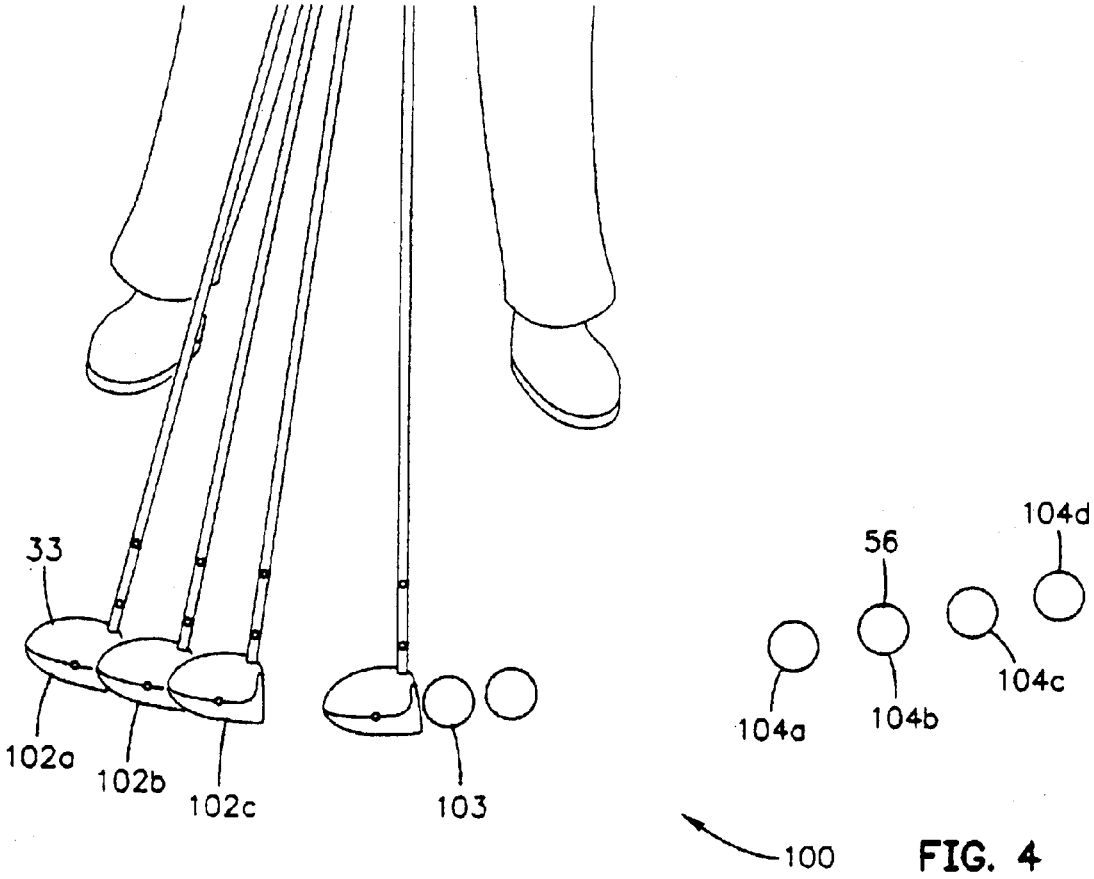
FIG. 4
FIG. 5
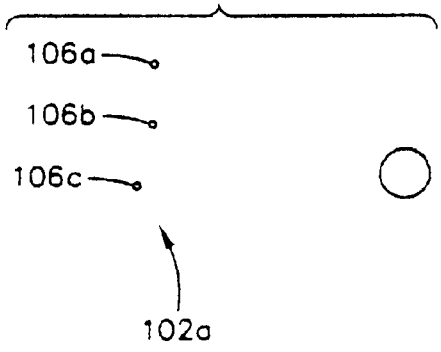
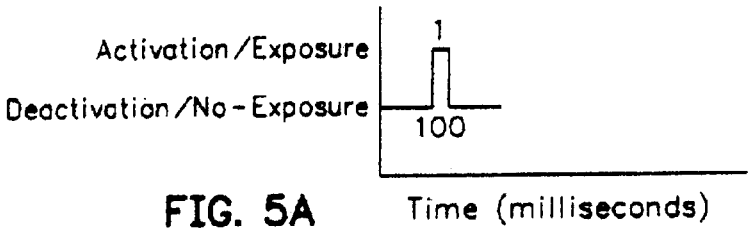
FIG. 5A

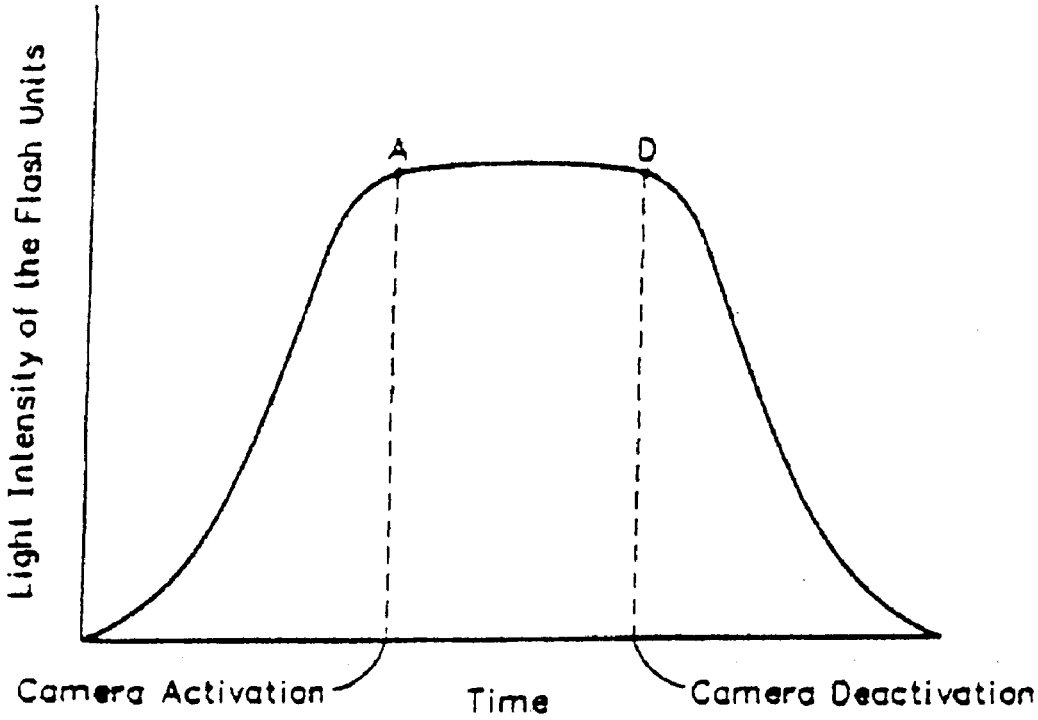
FIG. 5B
FIG. 6
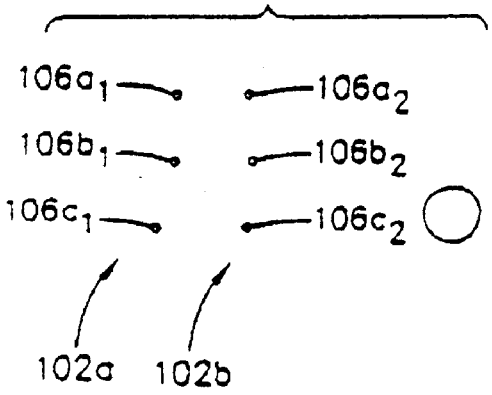
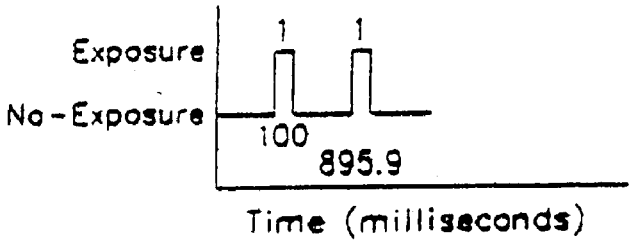
FIG. 6A

FIG. 7
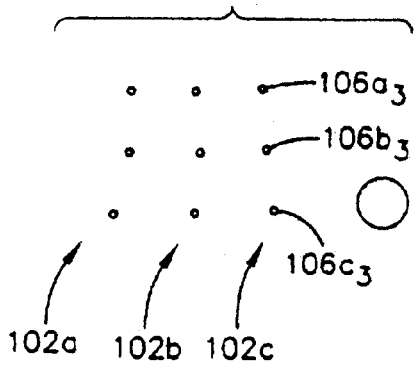
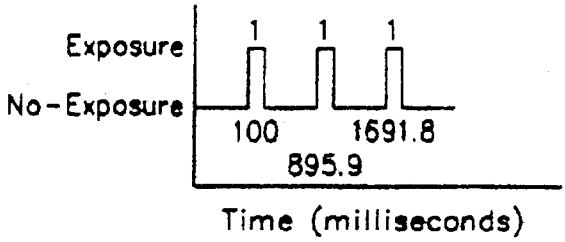
FIG. 7A
FIG. 8
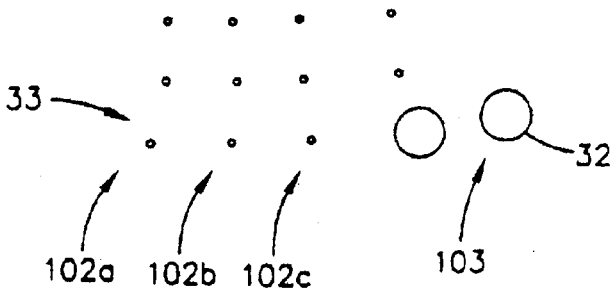
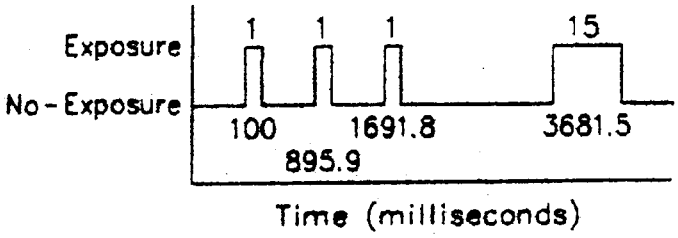
FIG. 8A

FIG. 9
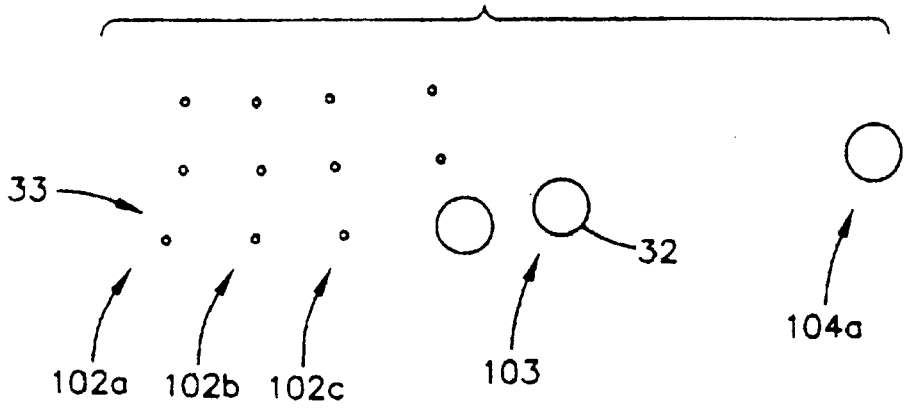
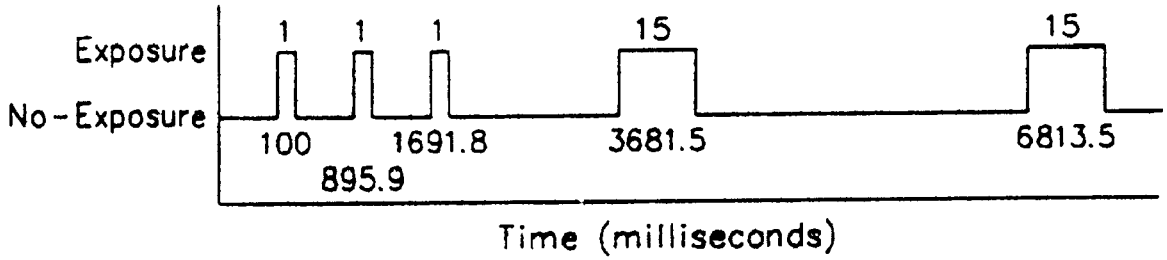
FIG. 9A

| Point | World X | World Y | World Z | Error |
|---|---|---|---|---|
| 1 | 29.450 | -103.307 | -233.802 | 1.038 |
| 2 | 30.831 | -85.566 | -265.861 | 1.256 |
| 3 | -6.378 | -103.560 | -234.665 | 1.051 |
| 4 | -6.133 | -85.495 | -266.727 | 1.239 |
| 5 | -42.418 | -104.266 | -234.779 | 1.099 |
| 6 | -43.248 | -86.050 | -266.888 | 1.226 |
| 7 | 46.192 | 14.770 | -290.289 | 0.201 |
| 8 | 5.158 | 15.938 | -291.271 | 0.005 |
| 9 | -35.937 | 16.234 | -291.519 | 0.121 |

SYSTEM AND METHOD FOR MEASURING A GOLFER'S BALL STRIKING PARAMETERS

CROSS REFERENCE TO THE RELATED APPLICATIONS

This application is a divisional application of U.S. patent application Ser. No. 09/765,691, filed on Jan. 19, 2001, now U.S. Pat. No. 6,431,990.

FEDERAL RESEARCH STATEMENT

[Not Applicable]

BACKGROUND OF INVENTION

1. Field of the Invention

The present invention relates to a system and method for measuring a golfer's launch parameters during a golf swing. More specifically, the present invention relates to a system and method for measuring club head information and golf ball information before and after impact of the golf club with the golf ball.

2. Description of the Related Art

For over twenty-five years, high speed camera technology has been used for gathering information on a golfer's swing. The information has varied from simple club head speed to the spin of the golf ball after impact with a certain golf club. Over the years, this information has fostered numerous improvements in golf clubs and golf balls, and assisted golfers in choosing golf clubs and golf balls that improve their game. Additionally, systems incorporating such high speed camera technology have been used in teaching golfers how to improve their swing when using a given golf club.

An example of such a system is U.S. Pat. No. 4,063,259 to Lynch et al., for a Method Of Matching Golfer With Golf Ball, Golf Club, Or Style Of Play, which was filed in 1975. Lynch discloses a system that provides golf ball launch measurements through use of a shuttered camera that is activated when a club head breaks a beam of light that activates the flashing of a light source to provide stop action of the club head and golf ball on a camera film. The golf ball launch measurements retrieved by the Lynch system include initial velocity, initial spin velocity and launch angle.

Another example is U.S. Pat. No. 4,136,387 to Sullivan, et al., for a Golf Club Impact And Golf Ball Launching Monitoring System, which was filed in 1977. Sullivan discloses a system that not only provides golf ball launch measurements, it also provides measurements on the golf club.

Yet another example is a family of patents to Gobush et al., U.S. Pat. No. 5,471,383 filed on Sep. 30, 1994; U.S. Pat. No. 5,501,463 filed on Feb. 24, 1994; U.S. Pat. No. 5,575,719 filed on Aug. 1, 1995; and U.S. Pat. No. 5,803,823 filed on Nov. 18, 1996. This family of patents discloses a system that has two cameras angled toward each other, a golf ball with reflective markers, a golf club with reflective markers thereon and a computer. The system allows for measurement of the golf club or golf ball separately, based on the plotting of points.

Yet another example is U.S. Pat. No. 6,042,483 for a Method Of Measuring Motion Of A Golf Ball. The patent discloses a system that uses three cameras, an optical sensor means, and strobes to obtain golf club and golf ball information.

Although the prior art has disclosed many useful systems, the prior art has failed to disclose a system that is capable of individualizing the calculations based on each individual golfer in order to provide information on the swing of the golfer and the launch of the golf ball subsequent to impact with the golf club. Further, the prior art has failed to disclose a system that allows for simultaneous imaging and analysis of the pre-impact golf club and post impact golf ball.

SUMMARY OF INVENTION

The present invention provides a method and system for capturing and analyzing golf club information and golf ball information during and after a golfer's swing is disclosed herein. The golf club information includes golf club head orientation, golf club head velocity, and golf club spin. The golf club head orientation includes dynamic lie, loft and face angle of the golf club head. The golf club head velocity includes path of the golf club head and attack of the golf club head. The golf ball information includes golf ball velocity, golf ball launch angle, golf ball side angle, golf ball speed and golf ball orientation. The golf ball orientation includes the true spin of the golf ball, and the tilt axis of the golf ball which entails the back spin and the side spin of the golf ball.

One aspect of the present invention is a method for simultaneously measuring the golf club properties and the golf ball properties during a golfer's striking of a golf ball. The method begins with the swinging of a golf club toward a teed golf ball. Next, a detector is activated as the golf club is swung toward the teed golf ball. The detector transmits an estimated golf club head speed to an imaging system. The imaging system capable of compiling a plurality of exposures to generate a frame. Next, a first plurality of exposures of the golf club head are taken prior to the golf club head impacting the teed golf ball. The first plurality of exposures have a first time interval period between exposures. Next, the teed golf ball is struck with the golf club. Next, a second plurality of exposures of the golf ball are taken after the golf ball has been struck by the golf club head. The second plurality of exposures has a second time interval between exposures. The second time interval is different than the first time interval. A frame is generated that includes the first plurality of exposures of the golf club head prior to impact with the teed golf ball and the second plurality of exposures of the golf ball after impact with the golf club head. The method provides measurements of the golf club head and of the launched golf ball.

The first time interval for the first plurality of exposures may be less than second time interval for the second plurality of exposures. The first time interval for the first plurality of exposures may range from 750 microseconds to 2000 microseconds, and the second time interval for the second plurality of exposures may be greater than the first time interval. The imaging system of the method preferably includes a first camera and a second camera. Each frame preferably includes at least three exposures of the first plurality of exposures, and at least three exposures of the second plurality of exposures. The measurements of the golf club include golf club head orientation, golf club head spin and golf club head velocity, and the measurements of the golf ball include the golf ball velocity, the golf ball launch angle, the golf ball side angle, the golf ball orientation (spin) and the golf ball speed. The estimated golf club head speed is utilized to determine the first time interval of the first plurality of exposures and the second time interval of the second plurality of exposures. The method preferably uses a laser to activate the detector as the golf club is swung toward the teed golf ball.

Another aspect of the present invention is a system for simultaneously measuring the golf club properties and the golf ball properties during a golfer's striking of a golf ball. The system includes a pair of cameras, a golf club, a teed golf ball, a detector, a calculating means and an analysis means. The first and second cameras each have a lens focused toward a predetermined field of view. The golf club has at least one light contrasting area, and preferably three light contrasting areas. The teed golf ball is within the predetermined field of view. The detector is disposed prior to the teed golf ball along a path of a golf club swing, and it is capable of estimating the golf club speed. The calculating means calculates a first time interval between a first plurality of exposures of the golf club and a second time interval between a second plurality of exposures of the launched golf ball based on the estimated golf club speed. The analysis means determines the golf club swing properties and golf ball launch properties based on an image frame generated by the first and second cameras which includes the first plurality of exposures and the second plurality of exposures.

Another aspect of the present invention is another method for simultaneously measuring the golf club properties and the golf ball properties during a golfer's striking of a golf ball. The method begins with the swinging of a golf club toward a teed golf ball. Next, a detector is triggered as the golf club is swung toward the teed golf ball. The detector transmits an estimated golf club head speed to an imaging system. The imaging system capable of compiling a plurality of exposures to generate a frame. Next, a first plurality of exposures of the golf club head are taken prior to the golf club head impacting the teed golf ball. Each of the first plurality of exposures has a first exposure intensity. Next, the teed golf ball is struck with the golf club. Next, a second plurality of exposures of the golf ball are taken after the golf ball has been struck by the golf club head. Each of the second plurality of exposures has a second exposure intensity. The second exposure intensity is different than the first exposure intensity. A frame is generated that includes the first plurality of exposures of the golf club head prior to impact with the teed golf ball and the second plurality of exposures of the golf ball after impact with the golf club head. The method provides measurements of the golf club head and of the launched golf ball.

Yet another aspect of the present invention is another method for simultaneously measuring the golf club properties and the golf ball properties during a golfer's striking of a golf ball. The method begins with the swinging of a golf club toward a teed golf ball. Next, a detector is activated as the golf club is swung toward the teed golf ball. The detector transmits an estimated golf club head speed to an imaging system. The imaging system capable of compiling a plurality of exposures to generate a frame. Next, a first plurality of exposures of the golf club head are taken prior to the golf club head impacting the teed golf ball. Each of the first plurality of exposures has a first time interval. Next, the teed golf ball is struck with the golf club. Next, a second plurality of exposures of the golf ball are taken after the golf ball has been struck by the golf club head. Each of the second plurality of exposures has a second time interval. The second time interval is greater than the first time interval. A frame is generated that includes the first plurality of exposures of the golf club head prior to impact with the teed golf ball and the second plurality of exposures of the golf ball after impact with the golf club head. The method provides measurements of the golf club head and of the launched golf ball.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF DRAWINGS

FIG. 4 is an image frame of a golfer's swing and subsequent launch of a golf ball composed of a multitude of exposures generated by the system of the present invention.

FIG. 5 is a partial image frame of a golfer's swing illustrating a first exposure of the highly reflective points on a golf club.

FIG. 5A is a graph of the time (x-axis) versus activation/deactivation for the exposure of FIG. 5.

FIG. 5B is a graph of time (x-axis) versus light intensity of the flash units to demonstrate the activation and deactivation points for the cameras.

FIG. 6 is a partial image frame of a golfer's swing illustrating first and second exposures of the highly reflective points on a golf club.

FIG. 6A is a graph of the time (x-axis) versus activation/deactivation for the exposures of FIG. 6.

FIG. 7 is a partial image frame of a golfer's swing illustrating first, second and third exposures of the highly reflective points on a golf club.

FIG. 7A is a graph of the time (x-axis) versus activation/deactivation for the exposures of FIG. 7.

FIG. 8 is a partial image frame of a golfer's swing illustrating first, second and third exposures of the highly reflective points on a golf club, and the initial impact golf ball exposure.

FIG. 8A is a graph of the time (x-axis) versus activation/deactivation for the exposures of FIG. 8.

FIG. 9 is a partial image frame of a golfer's swing illustrating first, second and third exposures of the highly reflective points on a golf club, the initial impact golf ball exposure, and a first exposure of a golf ball after impact with the golf club.

FIG. 9A is a graph of the time (x-axis) versus activation/deactivation for the exposures of FIG. 9.

DETAILED DESCRIPTION

Figure 1:
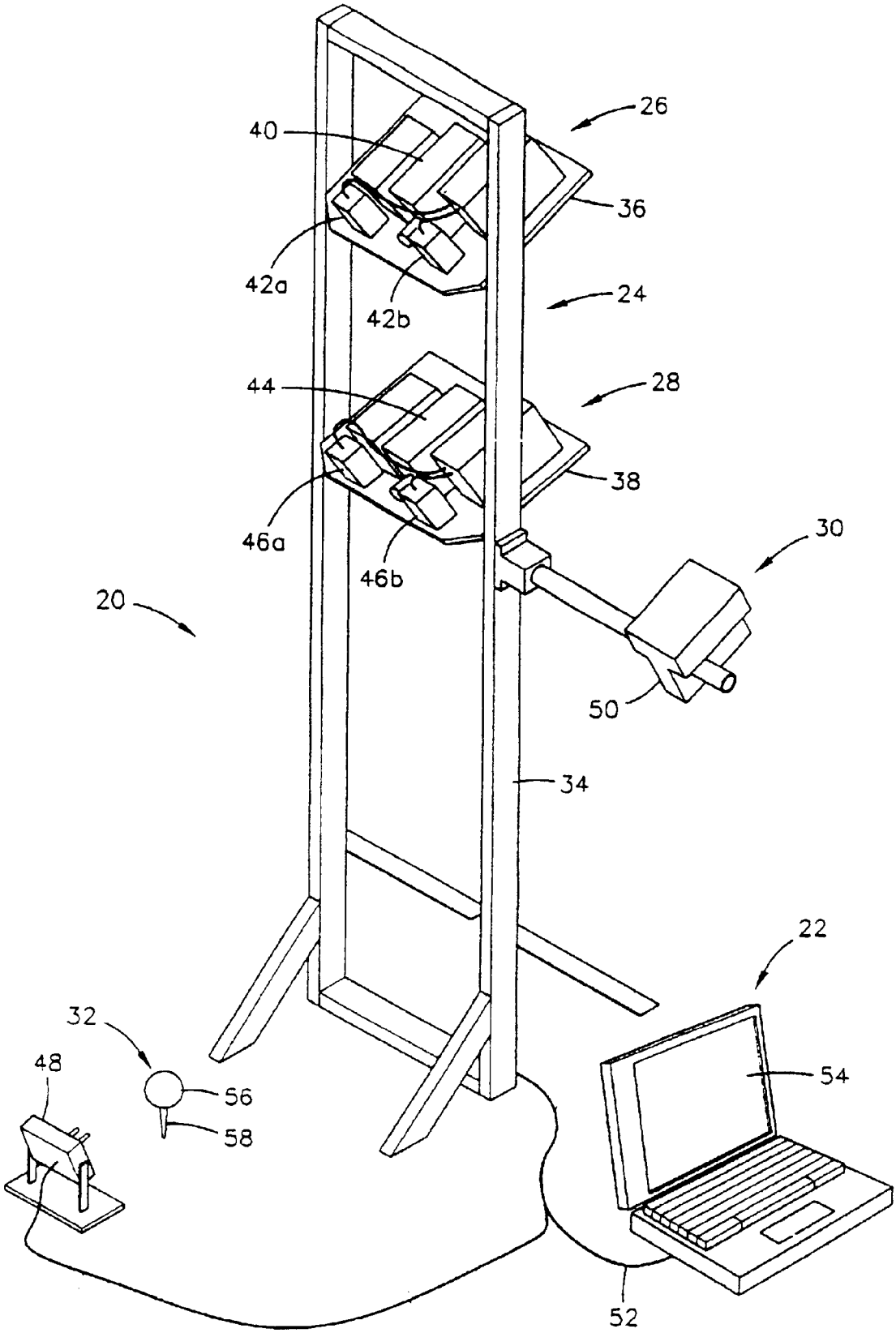
FIG. 1 is a perspective view of the monitoring system of the present invention.
Figure 2:
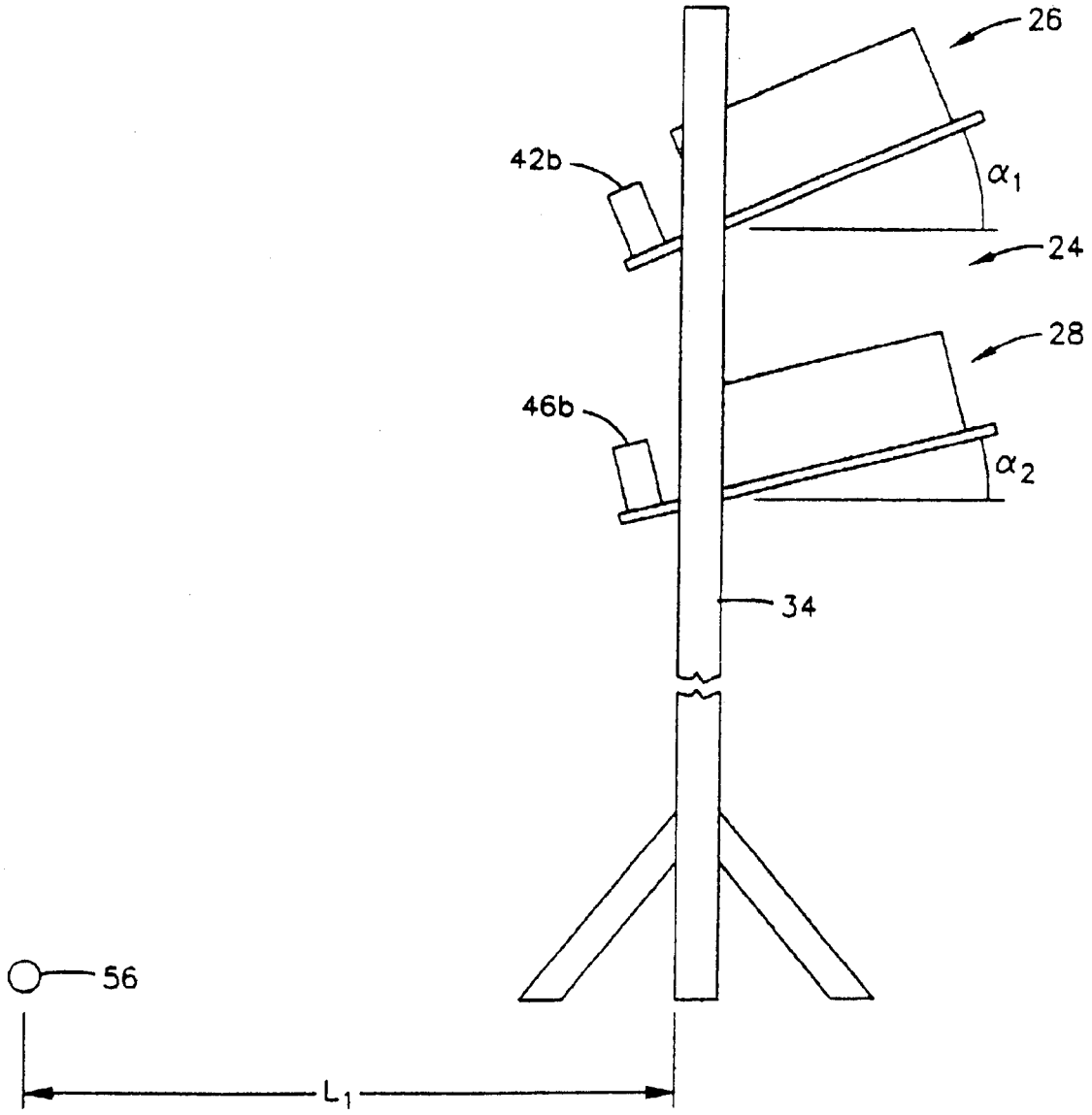
FIG. 2 is a schematic isolated side view of the teed golf ball and the cameras of the system of the present invention.
Figure 3:
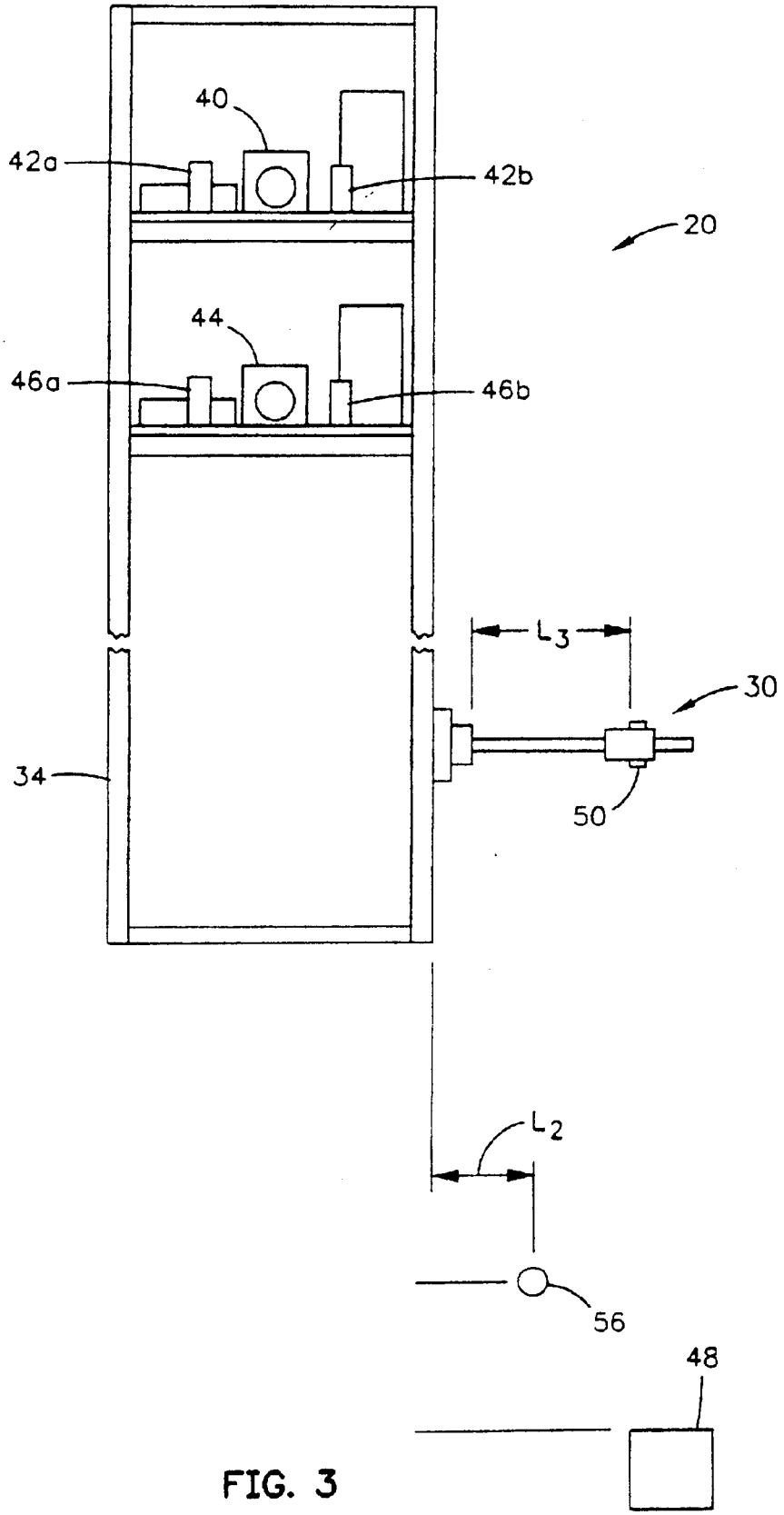
FIG. 3 is a schematic isolated front view of the teed golf ball, trigger device and the cameras of the system of the present invention.

As shown in FIGS. 1–3, the system of the present invention is generally designated 20. The system 20 captures and analyzes golf club information and golf ball information during and after a golfer's swing. The golf club information includes golf club head orientation, golf club head velocity, and golf club spin. The golf club head orientation includes dynamic lie, loft and face angle of the golf club head. The golf club head velocity includes path of the golf club head and attack of the golf club head. The golf ball information includes golf ball velocity, golf ball launch angle, golf ball side angle, golf ball speed and golf ball orientation. The golf ball orientation includes the true spin of the golf ball, and the tilt axis of the golf ball which entails the back spin and the side spin of the golf ball. The various measurements will be described in greater detail below.

The system 20 generally includes a computer 22, a camera structure 24 with a first camera unit 26, a second camera unit 28 and a trigger device 30, a teed golf ball 32 and a golf club 33. The system 20 is designed to operate on-course, at a driving range, inside a retail store/showroom, or at similar facilities.

In a preferred embodiment, the camera structure 24 is connected to a frame 34 that has a first platform 36 approximately 46.5 inches from the ground, and a second platform 38 approximately 28.5 inches from the ground. The first camera unit 26 is disposed on the first platform 36 and the second camera unit 28 is disposed on the second platform 38. As shown in FIG. 2, the first platform 36 is at an angle $\alpha_1$ which is approximately 41.3 degrees relative to a line perpendicular to the straight frame vertical bar of the frame 34, and the second platform 38 is at an angle $\alpha_2$ which is approximately 25.3 degrees relative to a line perpendicular to the straight frame vertical bar of the frame 34. However, those skilled in the relevant art will recognize that other angles may be utilized for the positioning of the cameras without departing from the scope and spirit of the present invention.

Figure 2A:
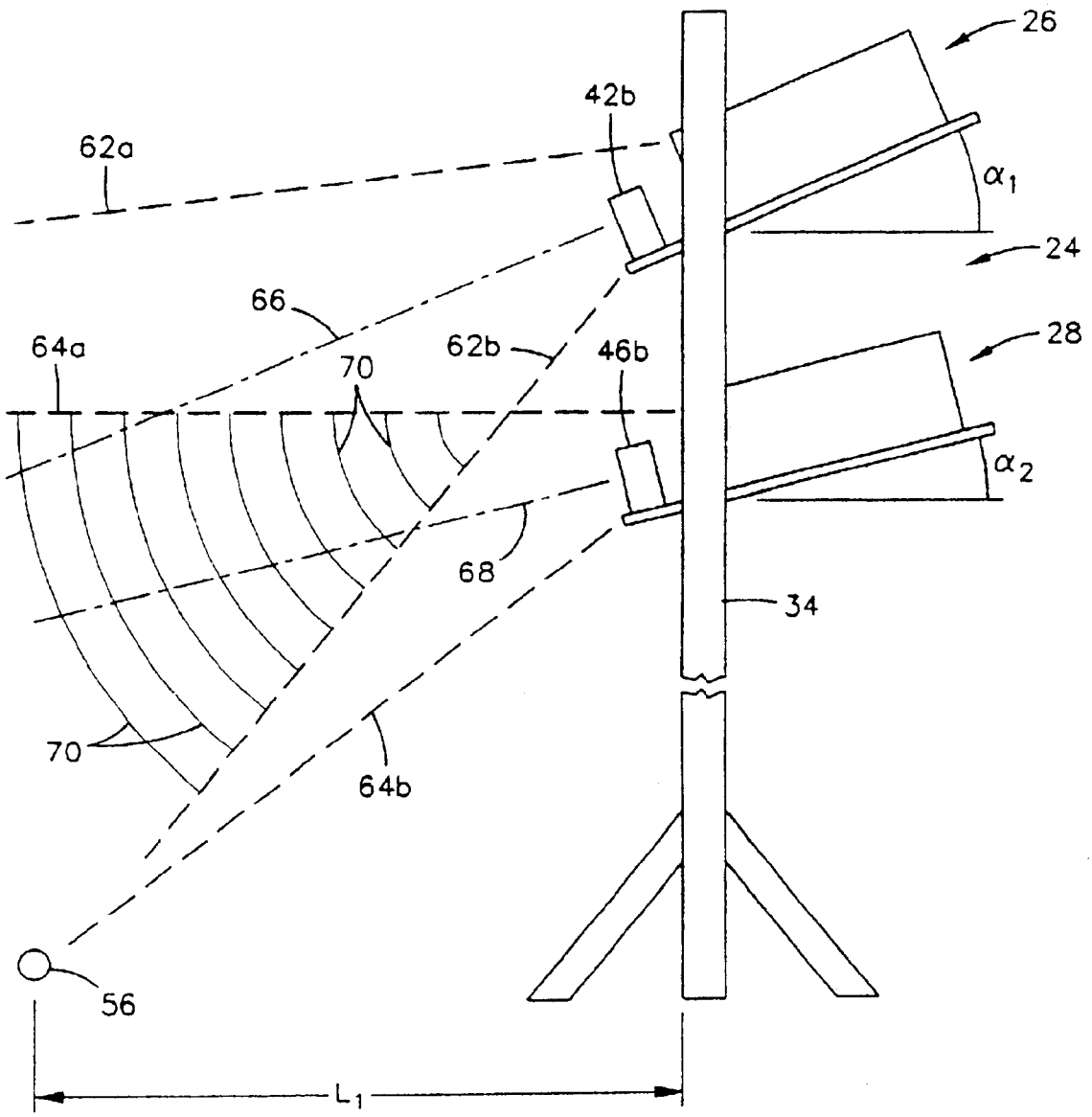
FIG. 2A is a schematic isolated side view of the teed golf ball and the cameras of the system showing the field of view of the cameras.

As shown in FIG. 2A, the platforms 36 and 38 are positioned such that the optical axis 66 of the first camera unit 26 does not overlap/intersect the optical axis 68 of the second camera unit 28. The optical view of the first camera unit 26 is bound by lines 62*a* and 62*b*, while the optical view of the second camera unit 28 is bound by lines 64*a* and 64*b*. The overlap area defined by curves 70 is the field of view of the system 20.

The first camera unit 26 includes a first camera 40 and flash units 42*a* and 42*b*. The second camera unit 28 includes a second camera 44 and flash units 46*a* and 46*b*. A preferred camera is a charged coupled device (CCD) camera available from Wintriss Engineering of California under the product name OPSIS1300 camera.

The trigger device 30 includes a receiver 48 and a transmitter 50. The transmitter 50 is preferably mounted on the frame 34 a predetermined distance from the camera units 26 and 28. A preferred trigger device is a laser device that transmits a laser beam from the transmitter 50 to the receiver 48 and is triggered when broken by a club swung toward the teed golf ball 32. The teed golf ball 32 includes a golf ball 56 and a tee 58. Other trigger devices such as optical detectors and audible detectors may be used with the present invention. The teed golf ball 32 is a predetermined length from the frame 34, $L_1$, and this length is preferably 38.5 inches. However, those skilled in the pertinent art will recognize that the length may vary depending on the location and the placement of the first and second camera units 26 and 28. The transmitter 50 is preferably disposed from 10 inches to 14 inches from the cameras 40 and 44. The receiver 48 and transmitter 50, and hence the laser beam, are positioned in front of the teed ball 32 such that a club swing will break the beam, and hence trigger the trigger device 30 prior to impact with the teed ball 32. As explained in greater detail below, the triggering of the trigger device 30 will generate a command to the first and second camera units 26 and 28 to begin taking exposures of the golf club 33 prior to impact with the teed golf ball 32. The data collected is sent to the computer 22 via a cable 52 which is connected to the receiver 48 and the first and second camera units 26 and 28. The computer 22 has a monitor 54 for displaying an image frame generated by the exposures taken by the first and second camera units 26 and 28. The image frame 100 is the field of view of the cameras 40 and 44.

FIG. 4 is an image frame 100 of a driver shot of a golf ball. The image frame 100 includes a first plurality of exposures 102, an initial impact golf ball exposure 103 and a second plurality of exposures 104. The first plurality of exposures includes images of the golf club 33 prior to striking the teed golf ball 32. The second plurality of exposures 104 includes images of the golf ball 56 subsequent to being struck by the golf club 33. The first plurality of exposures 102 may be distinguished from the second plurality of exposures 104 by three different factors. First, the time interval between each of the first plurality of exposures 102 is shorter than the time interval between each of the second plurality of exposures 104. Second, the length of time of each exposure, or more precisely the time that the shutter of the camera is open, is shorter for each of the first plurality of exposures 102 than the time of exposure for each of the second plurality of exposures 104. Third, the intensity of each of the first plurality of exposures 102 is less than the intensity of each of the second plurality of exposures 104.

FIG. 5 is a first exposure 102*a* only illustrating the three reflective points on the golf club 33. The points 106*a–c* bare positioned, respectively, on the shaft on the heel and on the toe of the golf club 33. As shown in FIG. 5A, the exposure 102*a* is taken at time 100 milliseconds from the triggering of the trigger device 30, and the exposure time is 1 millisecond. The exposure time need only be 1 millisecond since the reflective points 106*a–c* provide such an intense illumination. The Y axis in FIG. 5A, and similar figures, represents the activation and deactivation of the cameras 40 and 44. FIG. 5B illustrates the activation and deactivation of the cameras 40 and 44 on a graph of the intensity of the flash units 42 and 46 which are charged and increase in intensity where at point A the cameras 40 and 44 activated and then deactivated at point D while the intensity of the flash units 42 and 46 is beginning to fall.

As shown in FIG. 6, a second exposure 102*b* of the first plurality of exposures 102 is added to the first exposure 102*a* of the first plurality of exposures 102. The second exposure 102*b* also only illustrates the three reflective points 106*a–c* of the golf club 33. As shown in FIG. 6A, the exposure 102*b* is taken at time 895.9 milliseconds from the triggering of the trigger device 30, and the exposure time is 1 millisecond. The time interval between the first plurality of exposures 102*a* and 102*b* is 795.9 milliseconds.

As shown in FIG. 7, a third exposure 102*c* of the first plurality of exposures 102 is added to the first exposure 102*a* and second exposure 102*b* of the first plurality of exposures 102. The third exposure 102*c* also only illustrates the three reflective points 106*a–c* of the golf club 33. As shown in FIG. 7A, the exposure 102*c* is taken at time 1691.8 milliseconds from the triggering of the trigger device 30, and the exposure time is 1 millisecond. The time interval between the first plurality of exposures 102*b* and 102*c* is 795.9 milliseconds. Thus, the time interval between the first plurality of exposures 102 is equal, and approximately 795.9 milliseconds.

FIG. 8 includes the previous exposures and an initial impact exposure 103 which is an exposure of the golf club and the golf ball 32 immediately after impact. As shown in FIG. 8A, the initial impact exposure 103 is taken at 3681.5 milliseconds from the triggering of the trigger device 30, and the exposure time is 15 milliseconds. The time interval between the initial impact exposure 103 and the first of the second plurality of exposures 104 allows for any image noise of the golf club 33 to be captured so not to contaminate the second plurality of exposures 104.

FIG. 9 is the first exposure 104*a* of the second plurality of exposures 104 of the golf ball 56 in flight added to the other exposures. The first exposure 104*a* only illustrates the golf ball 56. As shown in FIG. 9A, the exposure 104*a* is taken at time 6813.5 milliseconds from the triggering of the trigger device 30, and the exposure time is 15 milliseconds. The exposure time needs to be 15 milliseconds since the golf ball 56 is not as illuminating as the reflective points 106*a–c*.

Figure 10:
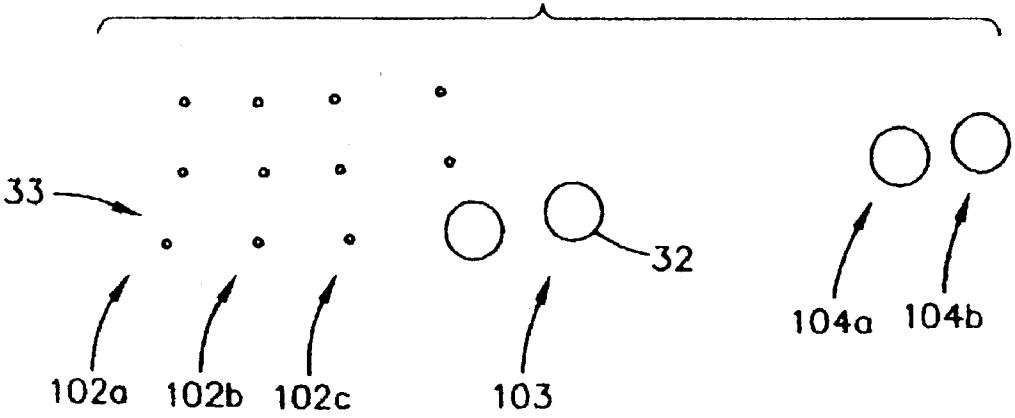
FIG. 10 is a partial image frame of a golfer's swing illustrating first, second and third exposures of the highly reflective points on a golf club, the initial impact golf ball exposure, and first and second exposures of a golf ball after impact with the golf club.
Figure 10A:
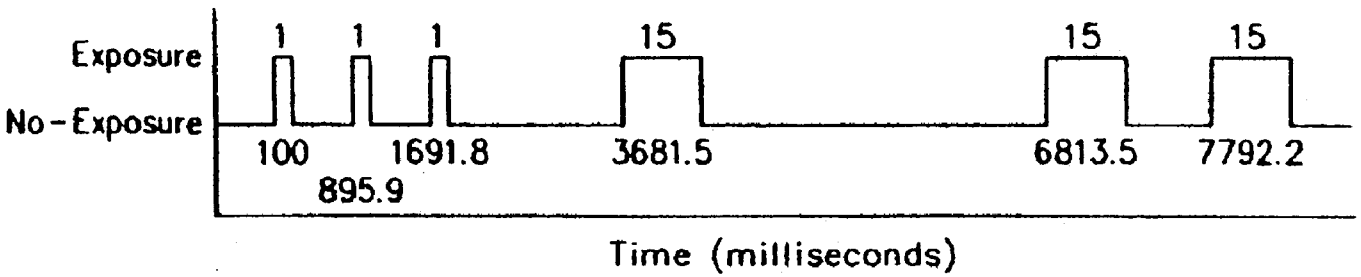
FIG. 10A is a graph of the time (x-axis) versus activation/deactivation for the exposures of FIG. 10.

FIG. 10 is the second exposure 104*b* of the second plurality of exposures 104 of the golf ball 56 in flight, added to the other exposures. The second exposure 104*b* only illustrates the golf ball 56. As shown in FIG. 10A, the exposure 104*b* is taken at time 7792.2 milliseconds from the triggering of the trigger device 30, and the exposure time is 15 milliseconds. The time interval between the second plurality of exposures 104*a* and 104*b* is 978.7 milliseconds.

Figure 11:
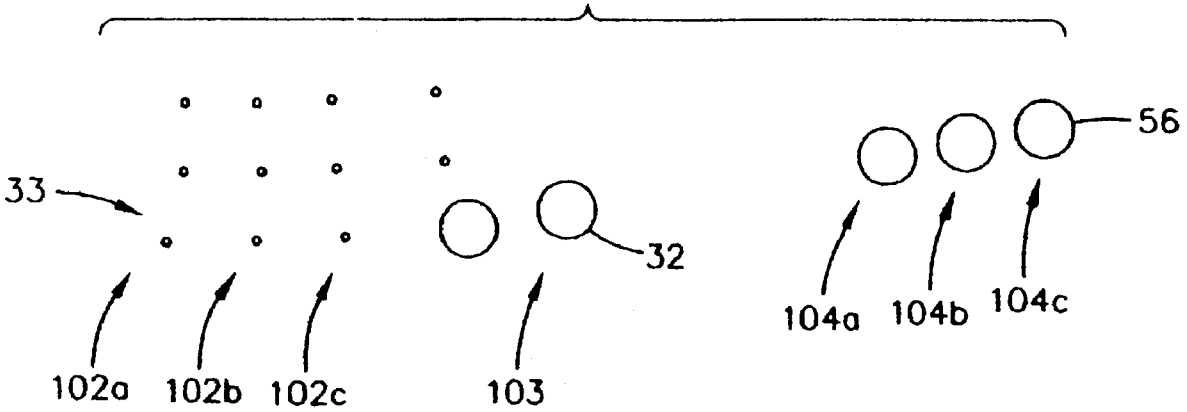
FIG. 11 is a partial image frame of a golfer's swing illustrating first, second and third exposures of the highly reflective points on a golf club, the initial impact golf ball exposure, and first, second and third exposures of a golf ball after impact with the golf club.
Figure 11A:
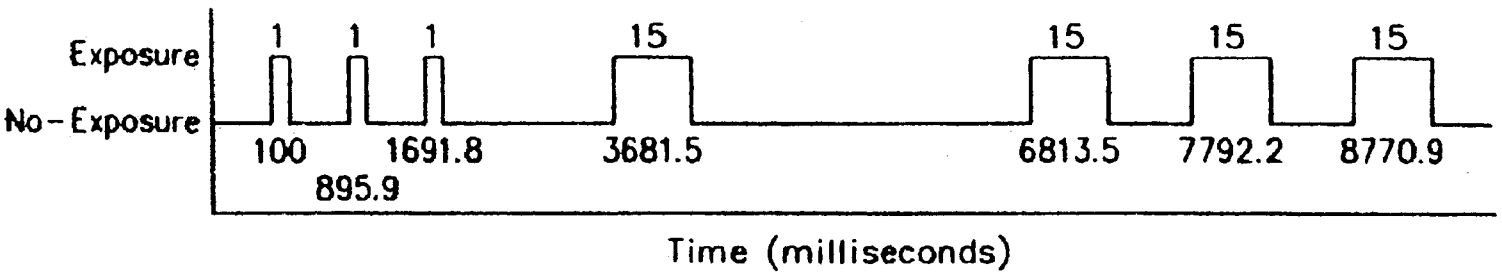
FIG. 11A is a graph of the time (x-axis) versus activation/deactivation for the exposures of FIG. 11.

FIG. 11 is the third exposure 104*c* of the second plurality of exposures 104 of the golf ball 56 in flight, added to the other exposures. The third exposure 104*c* only illustrates the golf ball 56. As shown in FIG. 11A, the exposure 104*c* is taken at time 8770.9 milliseconds from the triggering of the trigger device 30, and the exposure time is 15 milliseconds. The time interval between the second plurality of exposures 104*b* and 104*c* is 978.7 milliseconds. Thus, the time interval between the second plurality of exposures 104 is equal, and approximately 978.7 milliseconds, which is a greater time interval than the time interval between the first plurality of exposures.

Figure 12:
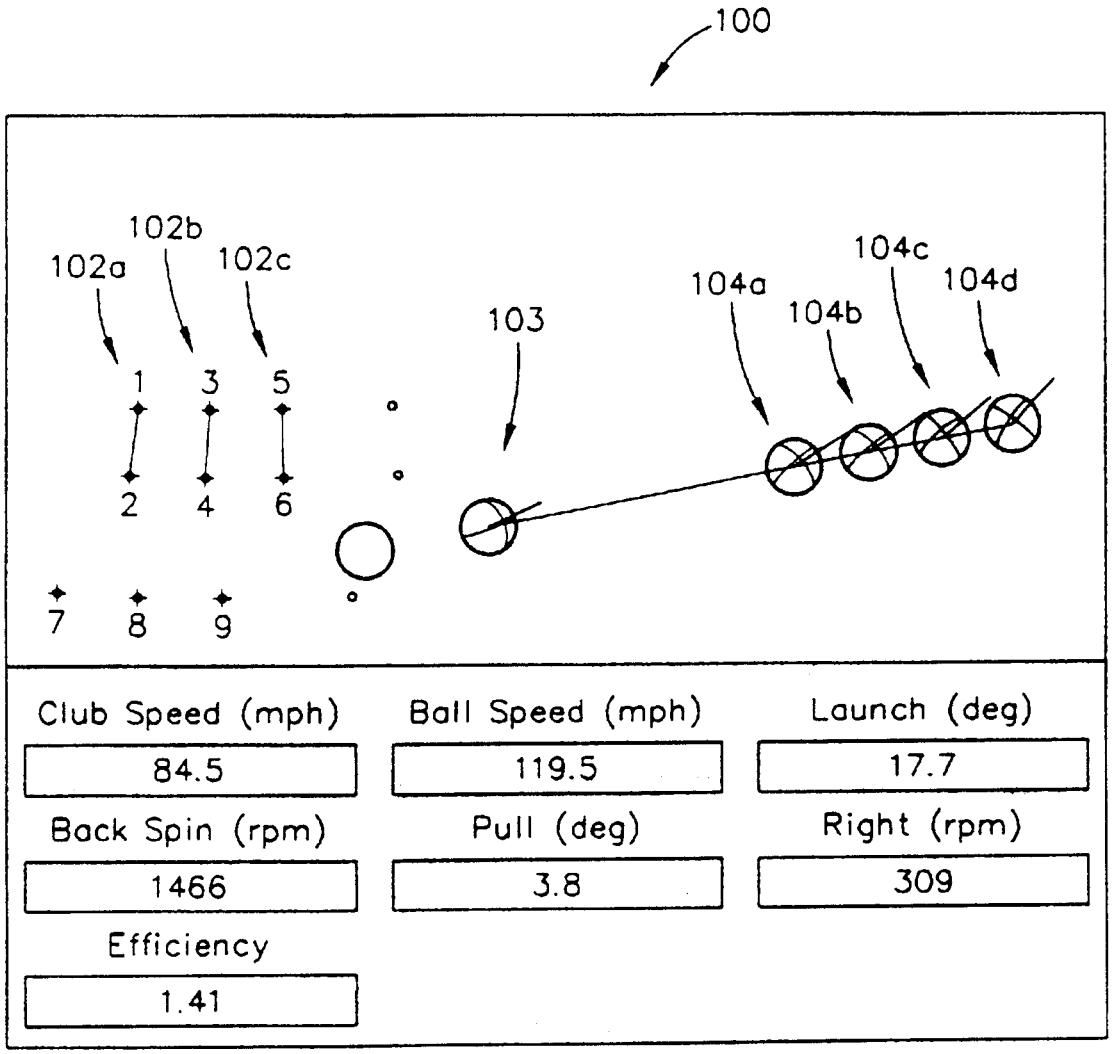
FIG. 12 is an image frame of a low speed driver shot with a plurality of exposures of the golf club and the golf ball.
Figure 13:
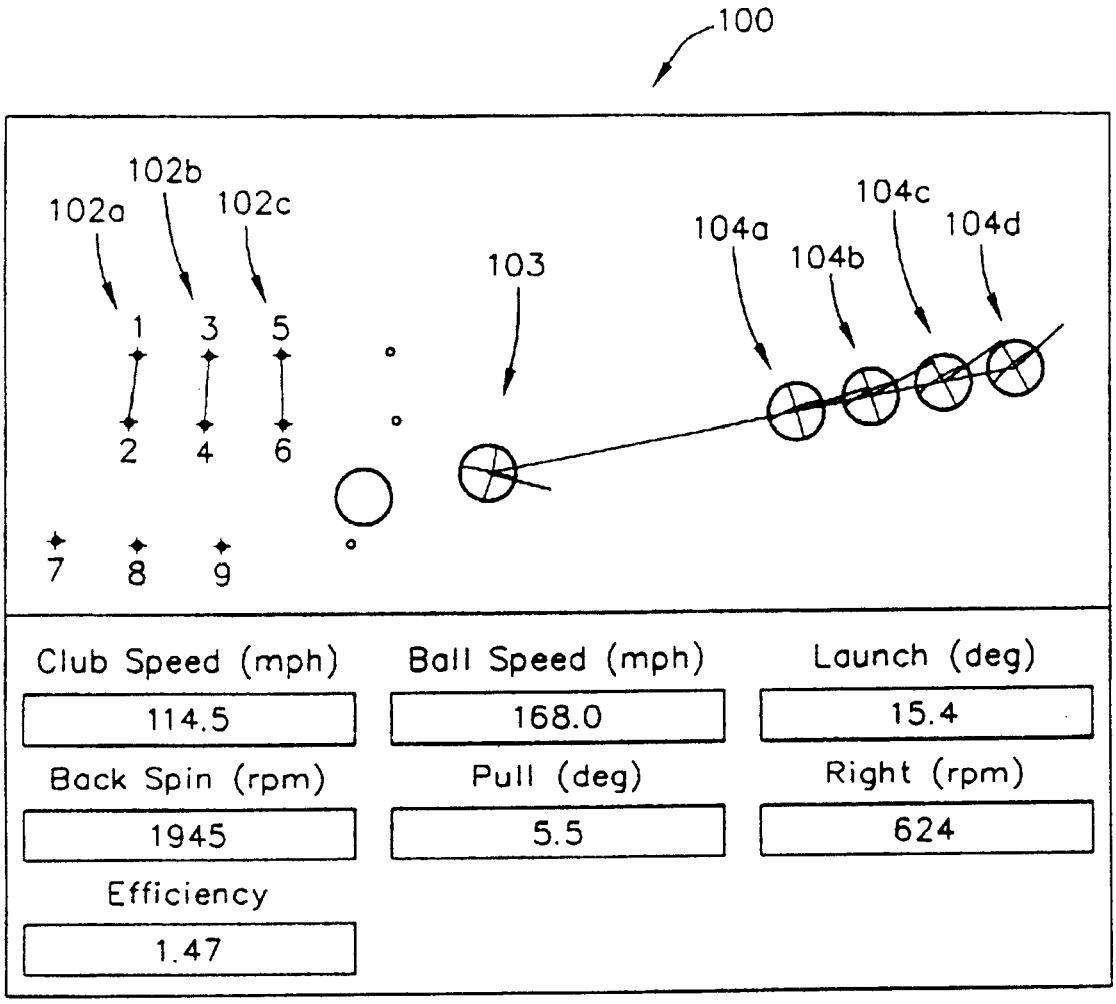
FIG. 13 is an image frame of a high speed driver shot with a plurality of exposures of the golf club and the golf ball.

FIGS. 12 and 13 compare a low speed driver swing to a high speed driver swing. The triggering of the trigger device 30 by the golf club 33 is used to determine the speed of golf club swing. As the golf club 33 breaks the beam, the triggering device 30 sends a signal with an estimate of the golf club swing speed to the first and second camera units 26 and 28. The signal tells the first and second camera units 26 and 28 to take the first plurality of exposures 102 at certain times and predetermined intervals, to take the initial impact exposure 103 at a certain time, and to take the second plurality of exposures 104 of the golf ball 56 in flight at certain times and predetermined intervals. Thus, the system 20 will have individual exposure times for each individual golfer's swing thereby creating a more accurate system 20 to determine the swing properties of a particular golfer.

For example, the low swing speed image frame 100 of FIG. 12 has the first plurality of exposures 102*a–c* taken at 100 milliseconds from the triggering for exposure 102*a,* 1429.72 milliseconds from the triggering for exposure 102*b,* and 2759.44 milliseconds from the triggering for exposure 102*c.* The initial impact exposure 103 is taken at 5443.88 milliseconds from the triggering. The second plurality of exposures 104*a–d* are taken at 9793.93 milliseconds from the triggering for exposure 104*a,* 10775.15 milliseconds from the triggering for exposure 104*b,* 11756.37 milliseconds from the triggering for exposure 104*c,* and 12737.59 milliseconds from the triggering for exposure 104*d.*

For comparison, the high swing speed image frame 100 of FIG. 13 has the first plurality of exposures 102*a–c* taken at 100 milliseconds from the triggering for exposure 102*a,* 956.38 milliseconds from the triggering for exposure 102*b,* and 1091.62 milliseconds from the triggering for exposure 102*c.* The initial impact exposure 103 is taken at 2083.24 milliseconds from the triggering. The second plurality of exposures 104*a–d* are taken at 4091.48 milliseconds from the triggering for exposure 104*a,* 7335.83 milliseconds from the triggering for exposure 104*b,* 8799.44 milliseconds from the triggering for exposure 104*c,* and 9531.25 milliseconds from the triggering for exposure 104*d.*

The golf club speed of the low speed swing is 84.5 miles per hour (MPH) compared to 114.5 MPH for the high swing speed. The golf ball speed of the low speed swing is 119.5 MPH compared to 168.0 MPH for the high speed swing. The back spin of the golf club is 1466 rotations per minute (RPM) for the low speed swing compared to 1945 RPM for the high speed swing. The launch angle of the golf ball for the low speed swing is 17.7 degrees compared to 15.4 degrees for the high speed swing.

The system 20 may be calibrated using many techniques known to those skilled in the pertinent art. One such technique is disclosed in U.S. Pat. No. 5,803,823 which is hereby incorporated by reference. The system 20 is calibrated when first activated, and then may operate to analyze golf swings for golfers until deactivated.

As mentioned above, the system 20 captures and analyzes golf club information and golf ball information during and after a golfer's swing. The system 20 uses the image frame 100 and other information to generate the information on the golfer's swing. The golf club 33 has at least two, but preferably three highly reflective points 106*a–c* preferably positioned on the shaft, heel and toe of the golf club 33. The highly reflective points 106*a–c* may be inherent with the golf club design, or each may be composed of a highly reflective material that is adhesively attached to the desired positions of the golf club 33. The points 106*a–c* need to be highly reflective since the cameras 40 and 44 are programmed to search for two or three points that have a certain brightness such as 200 out of a grey scale of 0–255. The cameras 40 and 44 search for point pairs that have approximately one inch separation, and in this manner, the image of the golf club 33 is acquired by the cameras for data acquisition.

Figure 14:
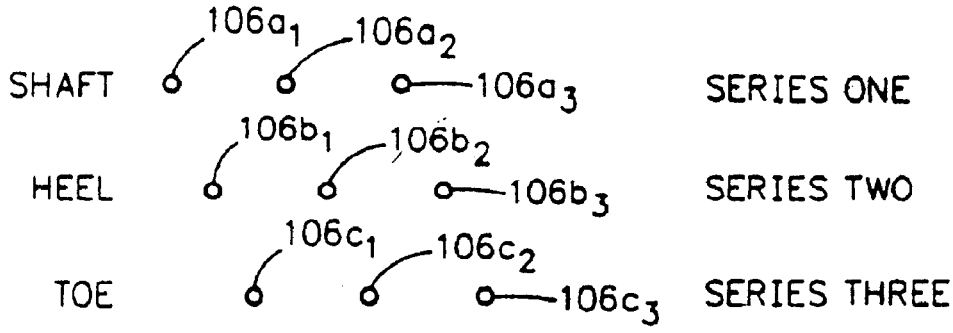
FIG. 14 is a schematic representation of the highly reflective points of the golf club positioned in accordance with the first, second and third exposures of the golf club.

As shown in FIG. 14, which is similar to FIG. 7, the first row of acquired highly reflective points 106*a* (on the shaft) is designated series one, the second row of acquired highly reflective points 106*b* (on the heel) is designated series two, and the third row of acquired highly reflective points 106*c* (on the toe) is designated series three. The first row is the acquired highly reflective points 106*a* from the shaft, the second row is the acquired highly reflective points 106*a* from the heel, and the third row is the acquired highly reflective points 106*a* from the toe. The following equation is used to acquire the positioning information:

$$d=[(Ptx-Pnx)^2+(Pty-Ptny)^2 \ldots]^{1/2}$$

where d is the distance, Ptx is the position in the x direction and Pty is the position in the y direction.

The system 20 may use a three point mode or a two point mode to generate further information. The two point mode uses $V_{toe}$, $V_{heel}$ and $V_{clubtop}$ to calculate the head speed.

$$V_{toe}=[(Ptx_3-Ptx_1)^2+(Pty_3-Pty_1)^2+(Ptz_3-Ptz_1)^2]^{1/2}[1/\Delta T]$$

$$V_{heel}=[(\mathrm{Ptx}_3-Ptx_1)^2+(pty_3-Pty_1)^2+(Ptz_3-Ptz_1)^2]^{1/2}[1/\Delta T]$$

$$V_{clubtop}=[V_{toe}+V_{heel}][1/2]$$

$$Vy=[(y_{3heel}-y_{1heel})^2+(y_{3toe}-y_{1toe})^2]^{1/2}[1/(2*\Delta T)]$$

$$Vz=[(z_{3heel}-z_{1heel})^2+(z_{3toe}-z_{1toe})^2]^{1/2}[1/(2*\Delta T)]$$

This information is then used to acquire the path angle and attack angle of the golf club 33. The Path angle=$\sin^{-1}$(Vy/[V]) where [V] is the magnitude of V.

The attack angle=$\sin^{-1}$(Vz/[V]), and the dynamic loft and dynamic lie are obtained by using Series one and Series two to project the loft and lie onto the vertical and horizontal planes.

The two point mode uses the shaft highly reflective point 106*a* or the toe highly reflective point 106*c* along with the heel highly reflective point 106*b* to calculate the head speed of the golf club, the path angle and the attack angle. Using the shaft highly reflective point 106*a,* the equations are:

$$V_{heel}=[(Ptx_3-Ptx_1)^2+(Pty_3Pty_1)^2+(Ptz_3-Ptz_1)^2]^{1/2}[1/\Delta T]$$

$$V_{shaft}=[(Ptx_3-Ptx_1)^2+(Pty_3-Pty_1)^2+(Ptz_3-Pty_1)^2]^{1/2}[1/\Delta T]$$

$$V_{center}=1.02*(V_{shaft}+V_{heel})$$

$$Vy=[(y_{3heel}-y_{1heel})^2+(y_{3shaft}-y_{1shaft})^2]^{1/2}[1/(2*\Delta T)]$$

$$Vz=[(z_{3heel}-z_{1heel})^2+(z_{3shaft}-z_{1shaft})^2]^{1/2}[1/(2*\Delta T)]$$

The Path angle=$\sin^{-1}$(Vy/[V]) where [V] is the magnitude of V.

The attack angle=$\sin^{-1}$(Vz/[V]).

Using the toe highly reflective point 106*c,* the equations are:

$$V_{toe}=[(x_3-x_1)^2+(y_3-y_1)^2+(z_3-z_1)^2]^{1/2}[1/\Delta T]$$

$$V_{heel}=[(x_2-x_1)^2+(y_2-y_1)^2+(z_2-z_1)^2]^{1/2}[1/\Delta T]$$

$$V_{clubtop}=[V_{toe}+V_{heel}][1/2]$$

The path angle=$\sin^{-1}(\mathrm{Vy}_{clubtop}/[\mathrm{V}_{clubtop}])$ where $[\mathrm{V}_{clubtop}]$ is the magnitude of $\mathrm{V}_{clubtop}$.

The attack angle=$\sin^{-1}(\mathrm{Vz}_{clubtop}/[\mathrm{V}_{clubtop}])$ where $[\mathrm{V}_{clubtop}]$ is the magnitude of $\mathrm{V}_{clubtop}$.

The golf ball 56 information is mostly obtained from the second plurality of exposures 104. First, the best radius and position of the two dimensional areas of interest are determined from the exposures 104. Next, all of the combinations of the golf ball 56 centers in the exposures 104 are matched and passed through a calibration model to obtain the X, Y, and Z coordinates of the golf ball 56. The system 20 removes the pairs with an error value greater then 5 millimeters to get acceptable X, Y, Z coordinates. Next, the strobe times from the flash units 42*a–b* and 46*a–b* are matched to the position of the golf ball 56 based on the estimated distance traveled from the exposures 104. Next, the velocity of the golf ball 56 is obtained from Vx, Vy and Vz using a linear approximation. Next the golf ball speed is obtained by calculating the magnitude of Vx, Vy and Vz.

The launch angle=$\sin^{-1}$(Vz/golf ball speed), and the spin angle=$\sin^{-1}$(Vy/golf ball speed).

Figure 15:
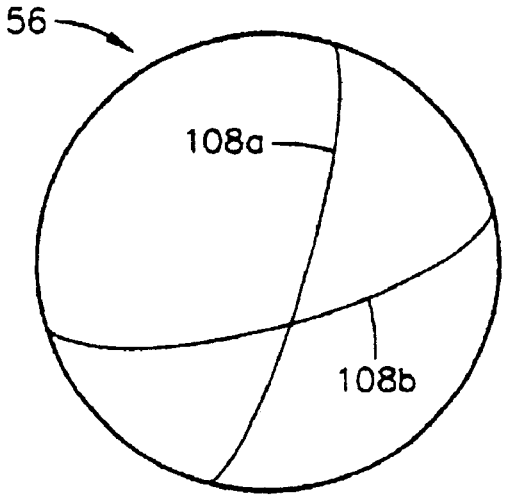
FIG. 15 is an isolated view of a golf ball striped for measurement using the present invention at a first exposure.
Figure 15A:
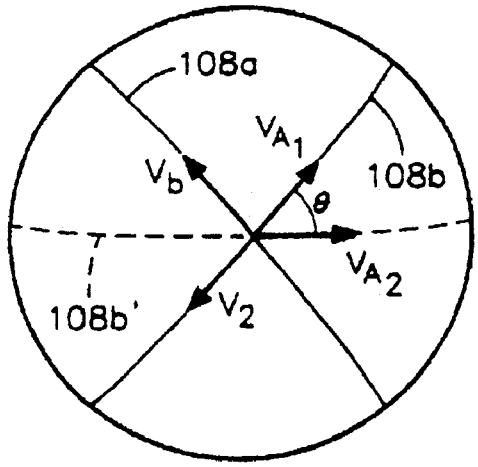
FIG. 15A is an isolated view of a golf ball striped for measurement using the present invention at a second exposure with a partial phantom of the first exposure with vector signs present to demonstrate calculation of angle $\ominus$.

Next, the system 20 looks for the stripes 108*a–b,* as shown in FIGS. 15 and 15A, on the golf ball 56 by using a random transformation searching for the spot of greatest contrast. X, Y and Z coordinates are used with the arc of stripe 108*a* and the arc of stripe 108*b* to orient the arc on the golf ball. Then, the system 20 determines which arc is most normal using $(x^2+y^2)^{1/2}$.

Next, the ⊖ angle of the golf ball 56 is measured by taking the first vector and the second vector and using the equation:

$\Theta=\cos^{-1}[(\text{vector } A\mathbf{1})(\text{vector } A\mathbf{2})]/([V_1][V_2])$ where $[V_1]$ is the magnitude of $V_1$ and $[V_2]$ is the magnitude of $V_2$.

As the golf ball 56 rotates from the position shown in FIG. 15 to the position shown in FIG. 15A, the angle ⊖ is determined from the position of vector A at both rotation positions. This allows for the spin to be determined. The back spin is calculated and applied to the first set of axis with a tilt axis of zero. The resultant vectors are compared to those of the next image and a theta is calculated for each of the vectors. This is done for each tilt axis until the Theta between the rotated first set of axis and the second set of axis is minimized.

The following is an example of how the system captures and analyzes golf club information and golf ball information during and after a golfer's swing. The golf club information includes golf club head orientation, golf club head velocity, and golf club spin. The golf club head orientation includes dynamic lie, loft and face angle of the golf club head. The golf club head velocity includes path of the golf club head, attack of the golf club head and downrange information. The golf ball information includes golf ball velocity, golf ball launch angle, golf ball side angle, golf ball speed manipulation and golf ball orientation. The golf ball orientation includes the true spin of the golf ball, and the tilt axis of the golf ball which entails the back spin and the side spin of the golf ball.

Figure 16:
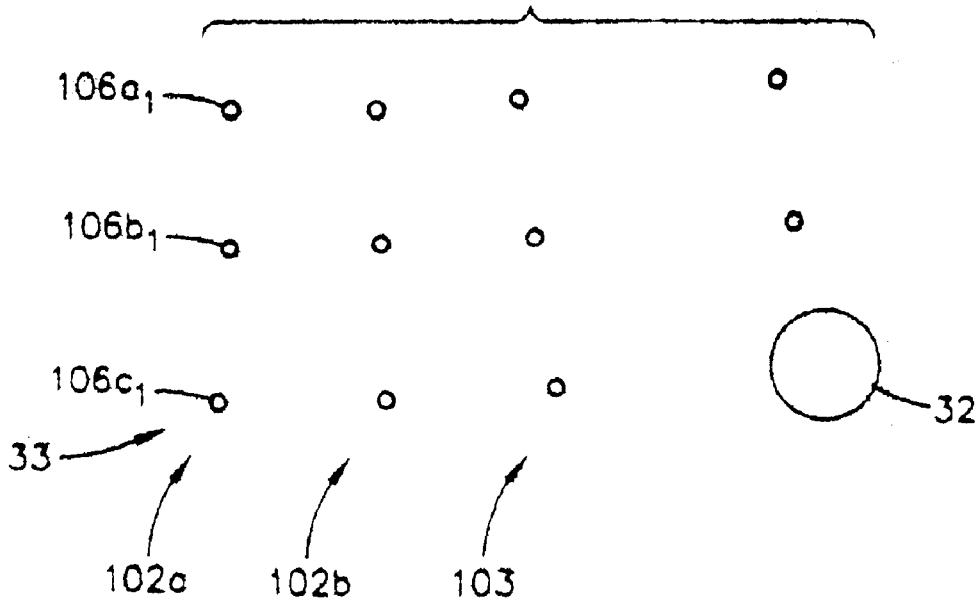
FIG. 16 is a partial image frame from only the first camera of a golfer's swing illustrating first, second and third exposures of the highly reflective points on a golf club, and the teed golf ball before determination of the threshold level on the grey scale.
Figure 17:
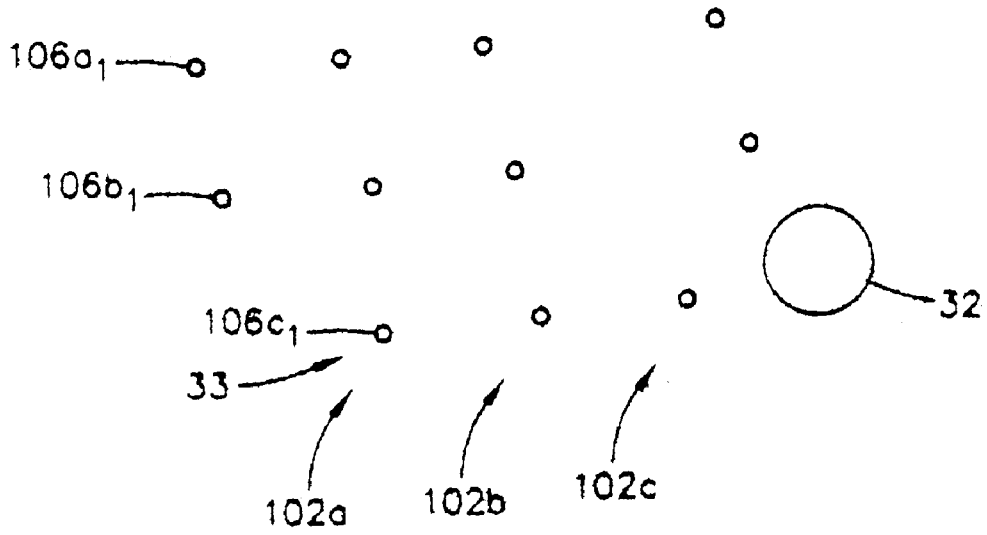
FIG. 17 is a partial image frame from only the second camera of a golfer's swing illustrating first, second and third exposures of the highly reflective points on a golf club, and the teed golf ball before determination of the threshold level on the grey scale.
Figure 18:
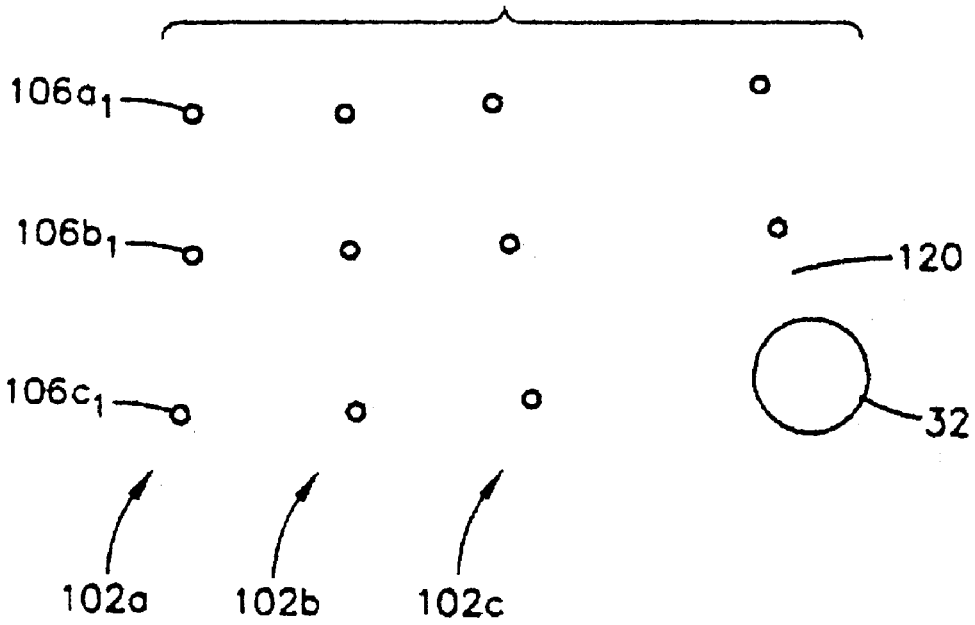
FIG. 18 is a partial image frame from only the first camera of a golfer's swing illustrating first, second and third exposures of the highly reflective points on a golf club, and the teed golf ball after determination of the threshold level on the grey scale.
Figure 19:
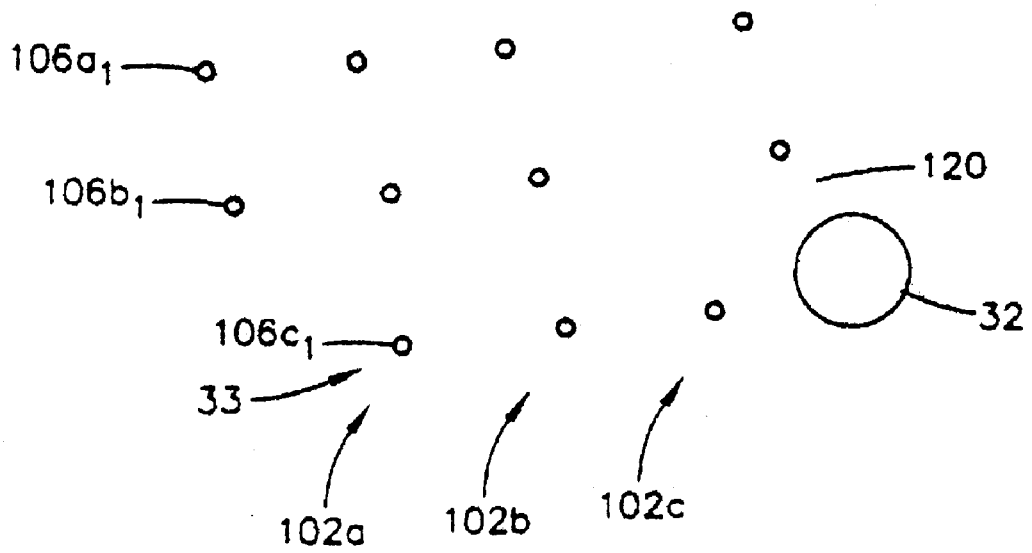
FIG. 19 is a partial image frame from only the second camera of a golfer's swing illustrating first, second and third exposures of the highly reflective points on a golf club, and the teed golf ball after determination of the threshold level on the grey scale.

First the golf club 33 information is obtained by the system 20 with the assistance of an operator in inputting some preliminary data. The size of the highly reflective points 106, separation of the highly reflective points 106, and threshold setting are inputted into the computer 22 by the operator. Next, as shown in FIGS. 16 and 17, a bounding area 120 is set about the teed golf ball 32 before the determining the threshold level on a grey scale of 0 to 255 which is a measurement of the light intensity. An appropriate setting of the threshold is 200 for the first plurality of exposures 102. The operator inputs a mark which designates the location of the teed ball 32. The bounding area 120 is determined to be the area to the left of this mark in order to analyze the first plurality of exposures 102. The system 20 then sets a threshold level to the left of the teed golf ball 32 looking for areas which are brighter then the threshold value. The system 20 then extracts the points from those greater than the threshold value. The threshold level of the bounding area 120 is set, as shown in FIGS. 18 and 19, which shows an absence of the golf ball 56 within the bounding area 120 since its brightness does not meet the threshold value.

Figure 20:
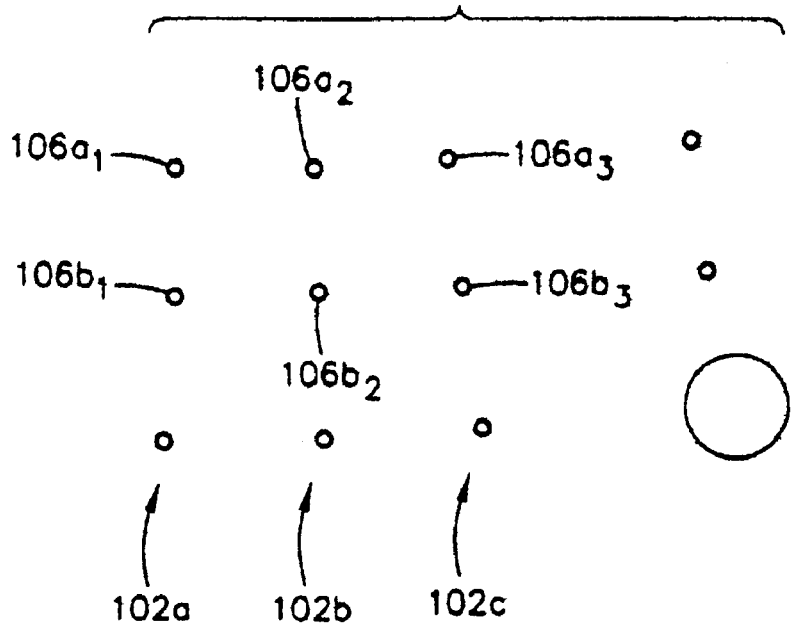
FIG. 20 is a partial image frame from only the first camera of a golfer's swing illustrating first, second and third exposures of the connected highly reflective points on a golf club, and the teed golf ball for the first find grouping of the highly reflective points.
Figure 21:
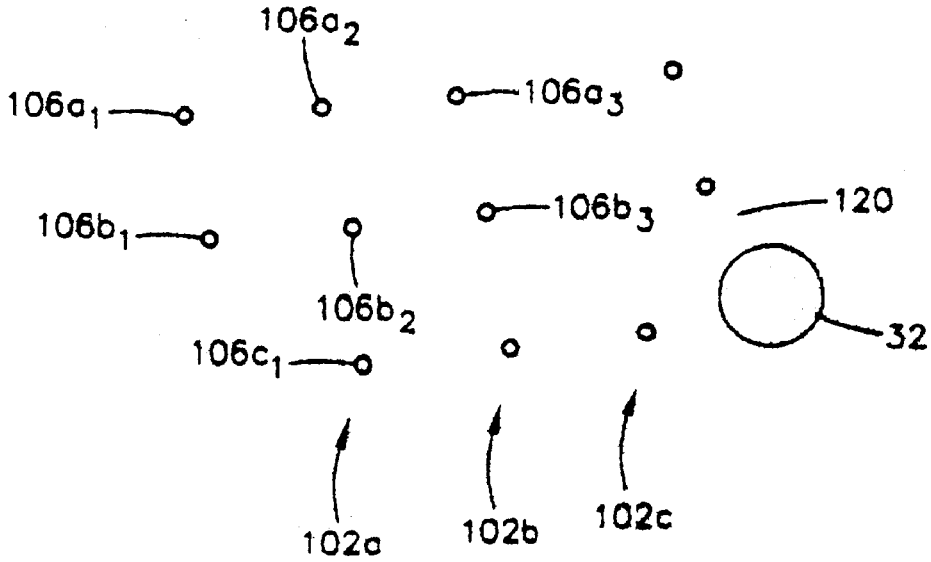
FIG. 21 is a partial image frame from only the second camera of a golfer's swing illustrating first, second and third exposures of the connected highly reflective points on a golf club, and the teed golf ball for the first find grouping of the highly reflective points.
Figure 22:
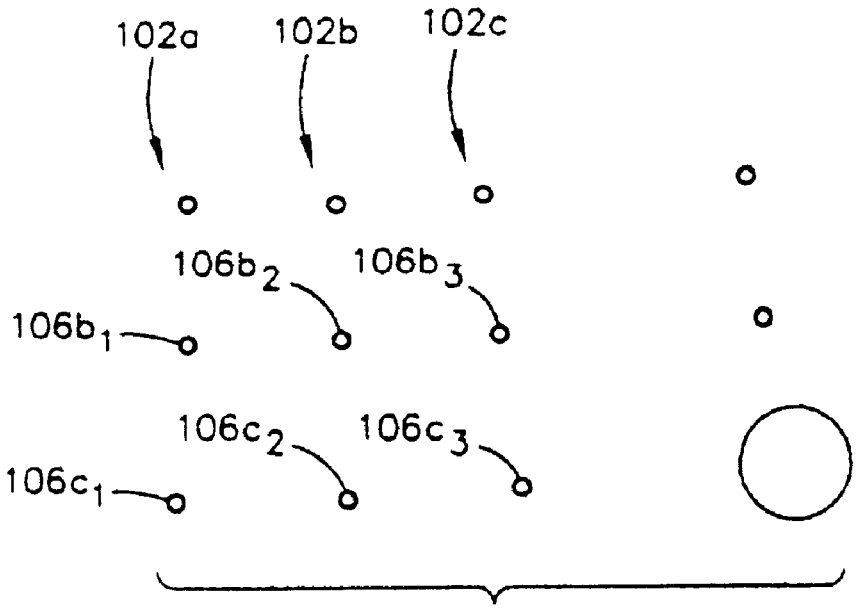
FIG. 22 is a partial image frame from only the first camera of a golfer's swing illustrating first, second and third exposures of the connected highly reflective points on a golf club, and the teed golf ball for the second find grouping of the highly reflective points.
Figure 23:
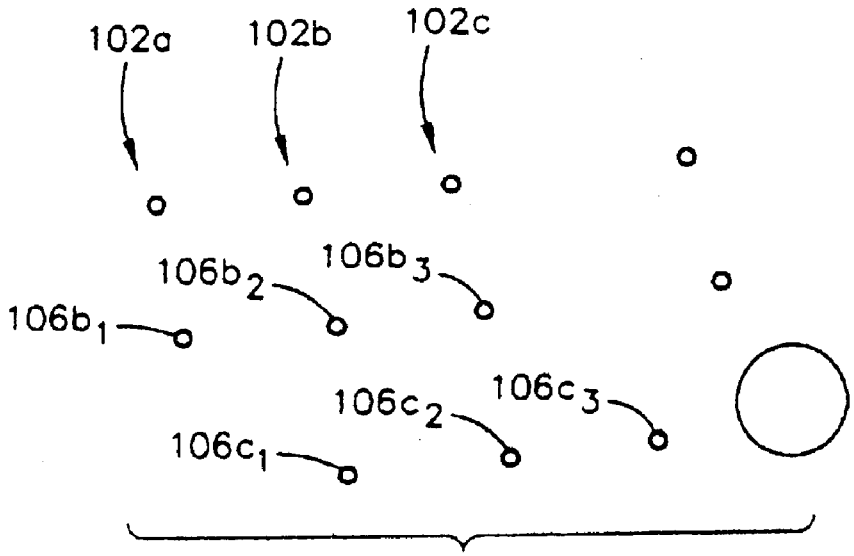
FIG. 23 is a partial image frame from only the second camera of a golfer's swing illustrating first, second and third exposures of the connected highly reflective points on a golf club, and the teed golf ball for the second find grouping of the highly reflective points.
Figure 24:
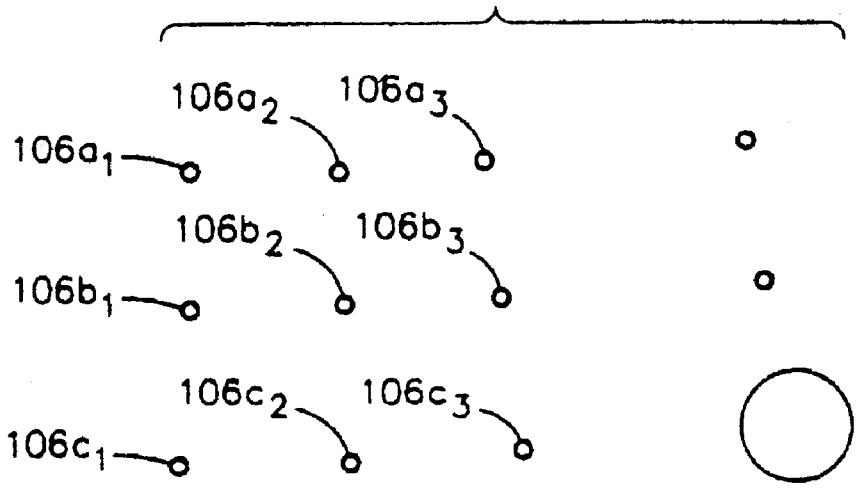
FIG. 24 is a partial image frame from only the first camera of a golfer's swing illustrating first, second and third exposures of the connected highly reflective points on a golf club, and the teed golf ball with repeated points eliminated and results of the find displayed.
Figure 25:
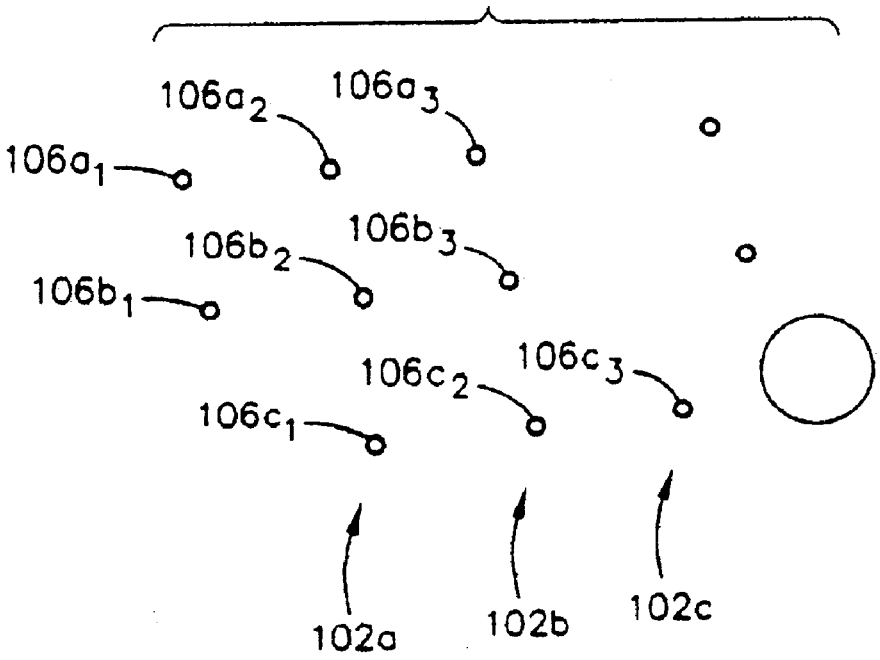
FIG. 25 is a partial image frame from only the second camera of a golfer's swing illustrating first, second and third exposures of the connected highly reflective points on a golf club, and the teed golf ball with repeated points eliminated and results of the find displayed.
Figures 26, 27:
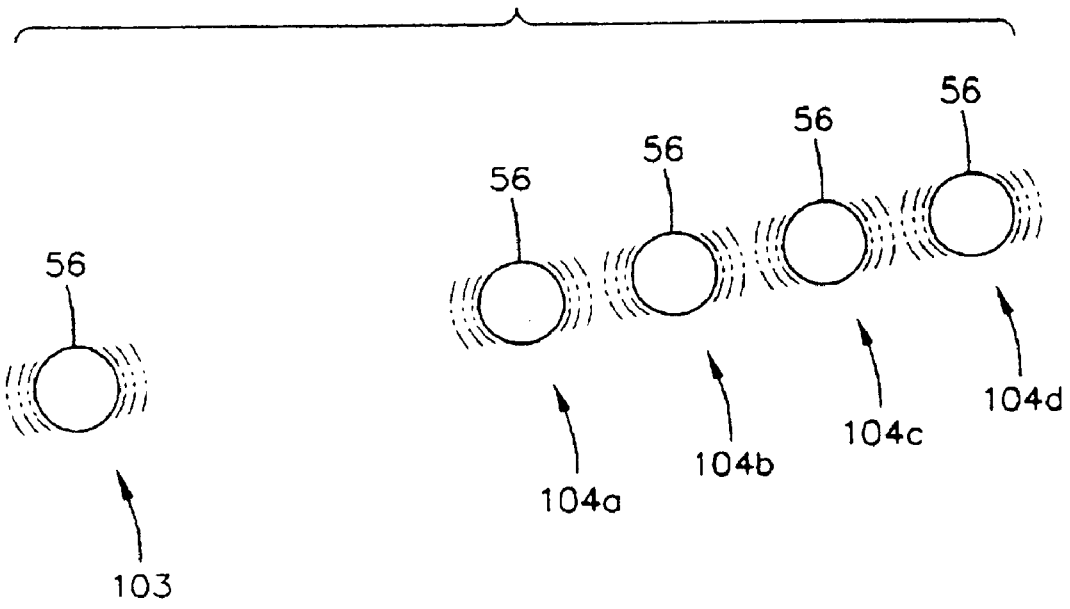
FIG. 26 is a chart of the processed final pairs giving the x, y and z coordinates.
FIG. 27 is an illustration of the thresholding of the exposures for the golf ball in flight.

Next, the system 20 pairs the points 106*a–c,* verifying size, separation, orientation and attack angle. Then, the system 20 captures a set of six points (three pairs) from a first find as shown in FIGS. 20 and 21. Then, the system 20 searches above and below the three pairs for a second find, as shown in FIG. 22 and 23. The repeated points 106 are eliminated and the results are displayed from the find, as shown in FIGS. 24 and 25. The points of the final pairs are processed by the computer 22 and displayed as shown in FIG. 26.

Next the speed of the head of the golf club 33 is determined by the system 20 using the equations discussed above.

Next the path angle and the attack angle of the golf club 33 is determined by the system 20. Using the methods previously described, the attack angle is determined from the following equation:

$$\text{Attack angle}=-\text{atan}(\Delta z/\Delta x)$$

Where Δ z is the z value of the midpoint between $\mathbf{106}a_1$ and $\mathbf{106}b_1$ minus the z value of the midpoint between $\mathbf{106}a_3$ and $\mathbf{106}b_3$. Where Δ x is the x value of the midpoint between $\mathbf{106}a_1$ and $\mathbf{106}b_1$ minus the x value of the midpoint between $\mathbf{106}a_3$ and $\mathbf{106}b_3$. The path angle is determined from the following equation:

$$\text{path angle}=-\text{atan}(\Delta y/\Delta x)$$

Where Δ y is the y value of the midpoint between $\mathbf{106}a_1$ and $\mathbf{106}b_1$ minus the y value of the midpoint between $\mathbf{106}a_3$ and $\mathbf{106}b_3$. Where Δ x is the x value of the midpoint between $\mathbf{106}a_1$ and $\mathbf{106}b_1$ minus the x value of the midpoint between $\mathbf{106}a_3$ and $\mathbf{106}b_3$.

Figure 28:
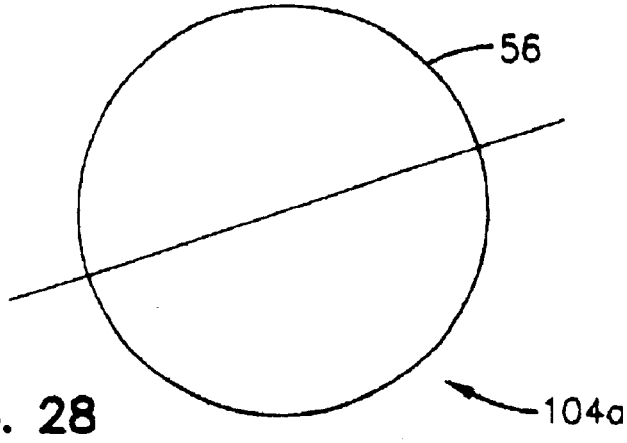
FIG. 28 is an isolated view of the golf ball to illustrate determining the best ball center and radius.
Figure 29:
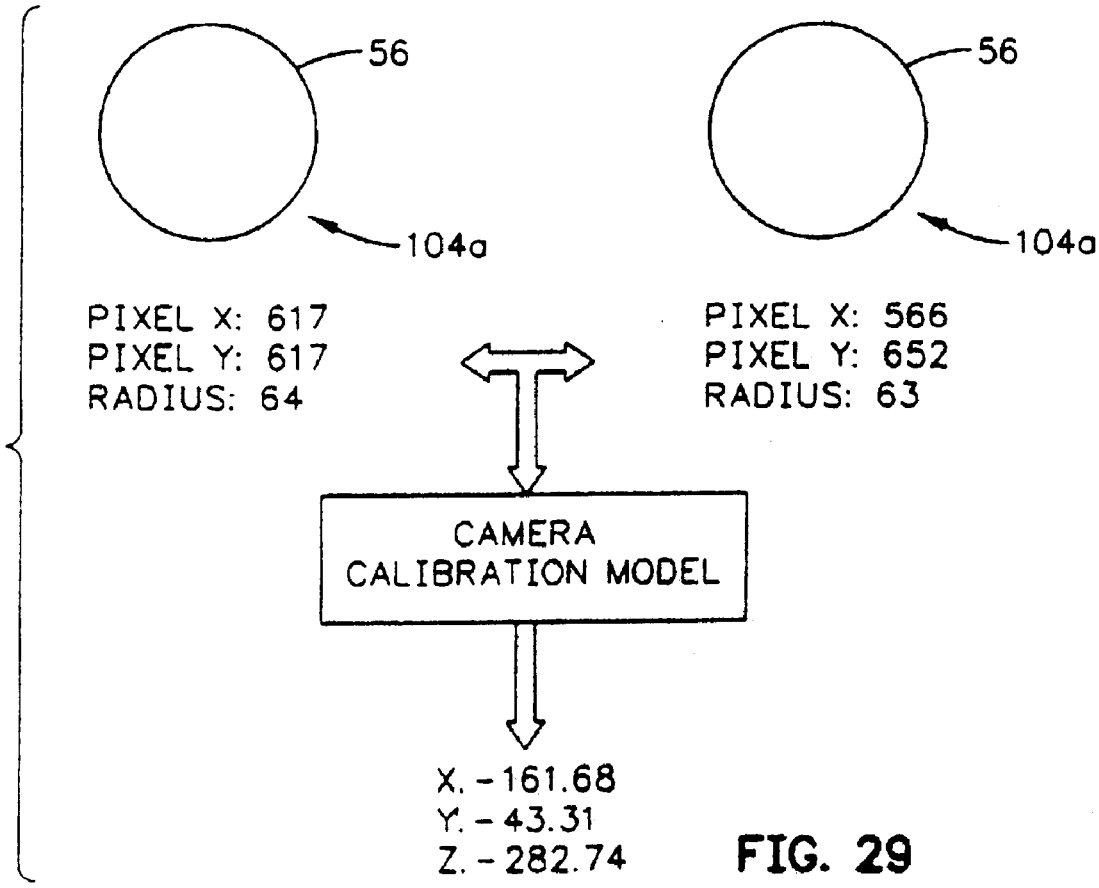
FIG. 29 is a partial flow chart with images of golf balls for stereo correlating two dimensional points.

Next, the golf ball 56 data is determined b the system 20. First, the thresholding of the image is established as shown in FIG. 27, at a lower grey scale value, approximately 100 to 120, to detect the golf ball 56. Next, well-known edge detection methods are used to obtain the best golf ball 56 center and radius, as shown in FIG. 28. Next, the stereo correlation of two dimensional points on the golf ball 56 is performed by the system 20 as in FIG. 29, which illustrates the images of the first camera 40 and the second camera 44.

Figure 30:
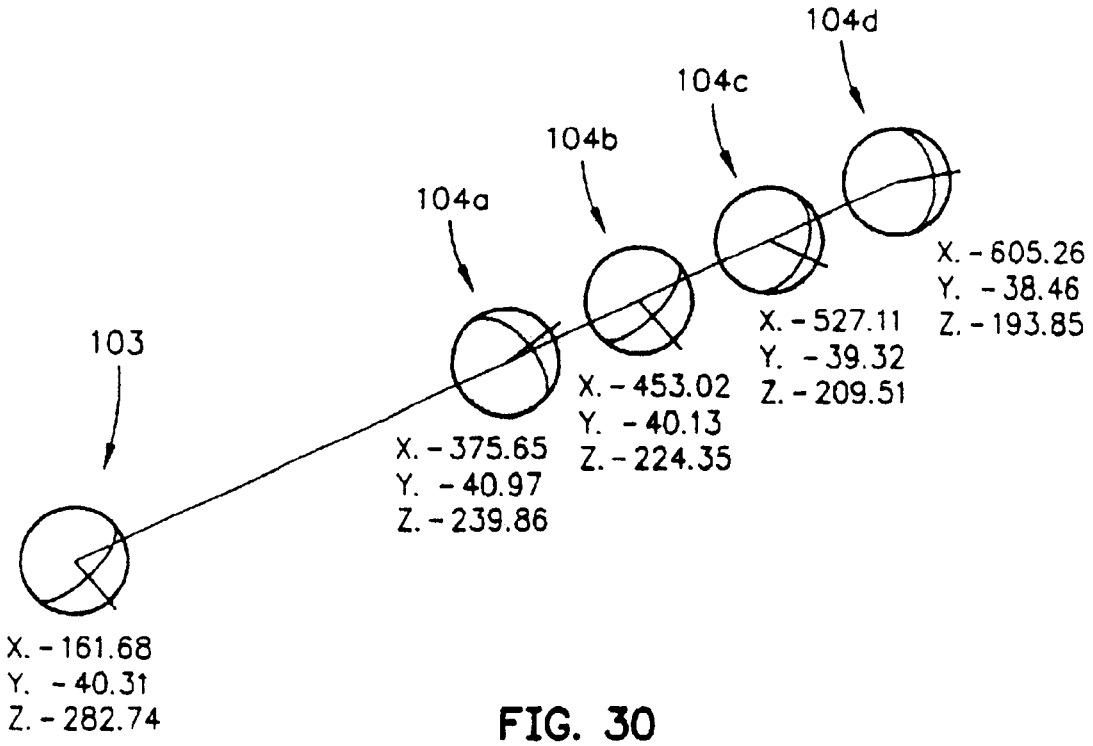
FIG. 30 is a partial image frame of the teed golf ball exposure and the first, second third and fourth exposures of the golf ball after impact, along with positioning information.

Next, based on the partial image frame 100 shown in FIG. 30, with the positioning information provided therein, the speed of the golf ball 56, the launch angle of the golf ball 56, and the side angle of the golf ball 56 is determined by the system 20. The speed of the golf ball is determined by the following equation:

$$\text{Golf ball speed}=[\Delta X^2+\Delta Y^2+\Delta Z^2]^{1/2}/\Delta T.$$

For the information provided in FIG. 30, the speed of the golf ball=$[(-161.68+(-605.26))^2+(-43.41+(-38.46))^2+(-282.74+(-193.85))^2]^{1/2}/(13127-5115)$, which is equal to 126 MPH once converted from millimeters over microseconds.

The launch angle of the golf ball 56 is determined by the following equation:

Launch angle=$\sin^{-1}$(*Vz*/golf ball speed) where $Vz=\Delta Z/\Delta T$. For the information provided in FIG. 30, $Vz=[(-282.74+(-193.85)]/(13127-5115)=11.3$ MPH. Then, the launch angle=$\sin^{-1}(11.3/126.3)=11.3$ degrees.

The side angle of the golf ball 56 is determined by the following equation:

Side angle=$\sin^{-1}$(*Vy*/golf ball speed) where *Vy 32* $\Delta Y/\Delta T$. For the information provided in FIG. 30, $Vy=[(-43.41+(-38.46)]/(13127-5115)=1.4$ MPH. Then, the side angle=$\sin^{-1}(1.4/126.3)=0.6$ degrees.

The ball spin is calculated by determining the location of the three striped on each of the acquired golf balls. Matching each axis in the field of view and determine which of the axis is orthogonal to the vertical plane. The spin is then calculated by: $\Theta$=acos ((vector A1 dot vector A2)/mag(v1)*mag (v2)) as discussed above.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A system for simultaneously measuring the golf club properties and the golf ball properties during a golfer's striking of a golf ball, the system comprising:

a first camera and a second camera, each of the first and second cameras focused toward a predetermined field view;

a golf club having at least one light contrasting area thereon;

a golf ball within the predetermined field of view;

a detector disposed prior to the golf ball along a path of a golf club swing, the detector capable of estimating the speed of the golf club swing during the golfer's striking of the golf ball;

means for calculating a first time interval between a first plurality of exposures of the golf club based on the estimation of speed of the golf club by the detector, and a second time interval between a second plurality of exposures of the launched golf ball, wherein a high speed golf club swing has a shorter first time interval than a low speed golf club swing; and means for determining a plurality of golf club swing properties and golf ball launch properties based on an image frame generated by the first and second cameras, the image frame comprising the first plurality of exposures and the second plurality of exposures.

2. The system according to claim 1 further comprising a first flash device for the first camera and a second flash device for the second camera.

3. The system according to claim 1 wherein the detector is a laser detector.

4. The system according to claim 1 wherein the detector is an audible detector.

5. The system according to claim 1 wherein the golf club has three highly reflective markers thereon.

6. The system according to claim 1 wherein the first time interval of the calculating means is less than the second time interval of the calculating means.

* * * * *